US008910648B2

(12) United States Patent
Jin

(10) Patent No.: US 8,910,648 B2
(45) Date of Patent: Dec. 16, 2014

(54) CONNECTOR DEVICE FOR A FOLDABLE TENT

(76) Inventor: Ki Ho Jin, Xiamen (CN)

( * ) Notice: Subject to any disclaimer, the term of this patent is extended or adjusted under 35 U.S.C. 154(b) by 4 days.

(21) Appl. No.: 13/572,622

(22) Filed: Aug. 11, 2012

(65) Prior Publication Data

US 2013/0014358 A1 Jan. 17, 2013

Related U.S. Application Data

(63) Continuation-in-part of application No. 13/397,117, filed on Feb. 15, 2012.

(30) Foreign Application Priority Data

Jul. 12, 2011 (CN) ..... 2011 2 0244599

(51) Int. Cl.
*E04H 15/60* (2006.01)
*E04H 15/48* (2006.01)

(52) U.S. Cl.
CPC ..... *E04H 15/48* (2013.01); *Y10S 135/909* (2013.01)
USPC ..... 135/114; 135/120.3; 135/909

(58) Field of Classification Search
USPC ..... 135/139, 144, 120.3, 909, 114; 16/337, 16/341, 348; 403/102, 116, 117, 157, 92, 403/93, 96, 97, 98
See application file for complete search history.

(56) References Cited

U.S. PATENT DOCUMENTS

| | | | | |
|---|---|---|---|---|
| 4,750,509 | A | 6/1988 | Kim | |
| 4,756,712 | A * | 7/1988 | Clover, Jr. | 623/39 |
| 5,195,551 | A | 3/1993 | Ju | |
| 5,666,986 | A | 9/1997 | Fox | |
| 5,884,646 | A | 3/1999 | Ju | |
| 6,200,060 | B1 | 3/2001 | Vernay | |
| 6,397,433 | B1 * | 6/2002 | Chen | 16/327 |
| 6,679,643 | B1 | 1/2004 | Ham | |
| 6,772,780 | B2 | 8/2004 | Price | |
| 7,003,849 | B2 * | 2/2006 | Cohen et al. | 16/232 |
| 7,621,289 | B2 * | 11/2009 | Ju | 135/120.3 |
| 7,942,159 | B2 | 5/2011 | Choi | |
| 2006/0037636 | A1 | 2/2006 | Lin | |
| 2006/0180190 | A1 | 8/2006 | Ju | |
| 2007/0051399 | A1 | 3/2007 | Jung | |
| 2011/0297201 | A1 * | 12/2011 | Chen | 135/144 |

* cited by examiner

*Primary Examiner* — Noah Chandler Hawk
(74) *Attorney, Agent, or Firm* — John H. Choi

(57) ABSTRACT

A connector device for retaining a pair of pivotally connected tent poles. The connector device comprises male and female components coupled to one another to permit positioning of the poles such that the poles are axially aligned in an aligned configuration and such that the poles are pivoted 180 degrees substantially parallel and adjacent to each other in a folded configuration. The male component includes an axially extending first guiding member and a first locking member formed on the inner projection, and the female component includes a second guiding member and a second locking member. The first and second locking members are engaged so as to secure the poles in the aligned configuration, and the first and second guiding members are engaged when the poles are in the aligned and folded configurations so as to further secure the poles in the respective configurations and to prevent misalignment of the poles.

11 Claims, 20 Drawing Sheets

300
302
304
310
312
314
316
318
320
322
324
326
330
332
334
338
340
342
344
350
352
354
356
358
360
362
364

CONNECTOR DEVICE FOR A FOLDABLE TENT

CROSS REFERENCES TO RELATED APPLICATIONS

This application is a continuation-in part of pending U.S. patent application Ser. No. 13/397,117, filed on Feb. 15, 2012, which is incorporated by reference in its entirety.

BACKGROUND OF THE INVENTION

The present invention relates to a foldable or collapsible tent, and more particularly to a connector device for retaining a pair of pivotally connected poles of a foldable tent.

For novice campers and camping families, among others, foldable tents are a popular alternative to conventional assemble-to-use tents. The cover and frame assembly of foldable tents are permanently attached to each other, i.e., preassembled, and are typically sold with a central hub and a plurality of poles pivotally attached to the hub. These tents are commonly referred to as "instant tents," "one-touch tents" or "pop-up tents," and erecting and collapsing the tent is easy and less time consuming than conventional assemble-to-use tents. Instant tents are particularly advantageous for smaller tents because a minimal number of poles, typically four, are required and thus erecting and collapsing the instant tent is quite simple. However, with larger tents, instant tents pose several problems.

For example, more poles and/or larger poles as well as a larger cover are required to support larger instant tents and thus erecting, collapsing and folding the instant tent could be challenging to the user. Specifically, the increased number of poles and pole sections requires extra steps to erect and collapse the tent. Moreover, the only method in which the larger instant tents can be folded is by surrounding the larger cover around the entire collapsed frame assembly. Because there is no systematic method of folding larger instant tents, it is difficult to consistently fold the tent into a tight, compact bundle.

As another example, larger components and an increased variety of parts are required to manufacture larger instant tents. For instance, larger parts are required to manufacture the central hub to accommodate the increased number of poles and poles of different lengths must be used to accommodate for the increased length of larger tents. Therefore, the instant tent is bulkier, material costs are increased significantly for the manufacturer, and increased manpower is necessary to assemble the variety of parts.

Another problem associated with larger instant tents is that the use of a central hub limits the overall configuration of the instant tent because the overall length of the tent is limited by the length of the poles which can securely extend from the hub. Therefore, a tent with a more elongated configuration cannot be achieved.

However, with larger foldable tents (and sometimes with smaller foldable tents as well) another problem exists in that the overall alignment of each tent pole could be compromised due to the longer poles that are utilized to accommodate for the size of the tent. Because each foldable section of the pole is longer than usual, in the event a portion of the pole is rotatably displaced even slightly along a longitudinal axis of the pole, that displacement is transferred throughout the pole and overall alignment is affected. For example, even with a small rotatable displacement at the upper portion of the pole, the displacement at the lower portion of the pole is magnified because of the length of the pole. This effect is particularly critical for the pole joint or connector device which couples the pole sections as the connector device connecting pole sections at a mid or lower portion of the pole are susceptible to misalignment. Specifically, when alignment of the pole is displaced—often times occurring when the tent is folded and further maneuvered to make more compact for storage—the position of the connector device could also shift such that each folded pole section is positioned in a reversed manner. When opening the tent and extending the pole sections from this defective folded configuration, unless a user realigns the pole sections and connector device prior to opening and extending the pole sections, it is possible that the user could mistakenly forcibly unfold the pole sections in the incorrect direction resulting in damage to the connector device.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is intended to overcome at least the above-described disadvantages. The objects and advantages of the present invention, more specifically, are to provide a pole joint or connector device that will remain aligned when the tent is opened and collapsed to prevent improper folding and unfolding of the poles and thus reducing the possibility of damage to the connector device.

For achieving the above-mentioned objects, the present invention provides a connector device for retaining a pair of pivotally connected poles, the connector device comprising: a male component comprising an outer section having a first cavity for receiving an end of one of the poles and an opposing inner section having an inner projection, the inner projection having opposing first and a second side walls, the inner projection having a first pivoting hole extending axially at a central portion; a first guiding member extending axially from the inner projection; a first locking member formed on the inner projection; a female component comprising an outer section having a second cavity for receiving an end of the other one of the poles and an opposing inner section having a housing for receiving the inner projection of the male component, the housing having a bottom wall and opposing first and second side walls, the first and second side walls having an axially extending second pivoting hole; a second guiding member extending axially from the housing; and a second locking member formed on the housing; wherein the male and female components are pivotally coupled together through the first and second pivoting holes, the first and second locking members are engaged so as to secure the poles in a substantially aligned configuration, and the first and second guiding members are engaged when the poles are in the aligned configuration and when the poles are pivoted 180 degrees substantially parallel and adjacent to each other in a folded configuration.

In one aspect of the present invention, the connector device comprises a male component comprising an outer section having a first cavity for receiving an end of one of the poles and an opposing inner section having an inner projection, the inner projection comprising: an axially extending first pivoting hole, an axially extending guide pin and a first locking member extending along a bottom portion of the inner projection; and a female component comprising an outer section having a second cavity for receiving an end of the other one of the poles and an opposing inner section having a housing for receiving the inner projection of the male component, the housing comprising a lower portion and two opposing side portions, each of the side portions having an axially extending second pivoting hole substantially aligned with each other, each of the side portions having opposing guide grooves, each guide groove having opposing ends, a distal end of the lower portion of the housing having a second locking member extending therefrom; wherein the male and female components are pivotally coupled through the first and second pivoting holes, the first and second locking members are lockably engaged when the poles are aligned, and the guide pin and guide groove ends are engaged when the poles are aligned longitudinally and when the poles are pivoted 180 degrees substantially parallel and adjacent to each other.

In another aspect of the present invention, the connector device comprises a male component comprising an outer section having a first cavity for receiving an end of one of the poles and an opposing inner section having an inner projection, the inner projection having opposing first and second sides, the inner projection comprising a first pivoting hole extending axially thereto, the inner projection first side having a pair of inner locking apertures partially extending axially through the inner projection, the pair of inner locking apertures substantially aligned diametrically, the inner projection second side having a substantially circular groove partially extending axially through the inner projection; a female component comprising an outer section having a second cavity for receiving an end of the other one of the poles and an opposing inner section having a housing for receiving the inner projection of the male component, the housing having a bottom wall and two opposing first and second side walls, each of the side walls having an axially extending second pivoting hole substantially aligned with each other, the first side wall having a pair of outer locking apertures extending axially through the first side wall, the pair of outer locking apertures substantially aligned diametrically and axially aligned with the inner locking apertures of the male component; a locking component comprising a third pivoting hole disposed proximate a center portion, the locking component further comprising a pair of spaced apart locking extensions extending from an inner wall axially aligned with the inner and outer locking apertures; and a biasing member disposed within the male component circular groove and substantially aligned axially with the pivoting holes; wherein the locking component, the male and female components, and biasing member are coupled together through the pivoting holes such that the locking extensions engage the inner and outer locking apertures of the male and female components, respectively, when the poles are aligned longitudinally in an aligned configuration and when the poles are pivoted 180 degrees substantially parallel and adjacent to each other in a folded configuration, and when the poles are in between the aligned and folded configurations the locking extensions extend through the outer locking apertures but disengage from the inner locking apertures.

BRIEF DESCRIPTION OF THE DRAWINGS

To better understand the present invention, a more particular description of the invention will be rendered by reference to the appended drawings.

Figure 1:
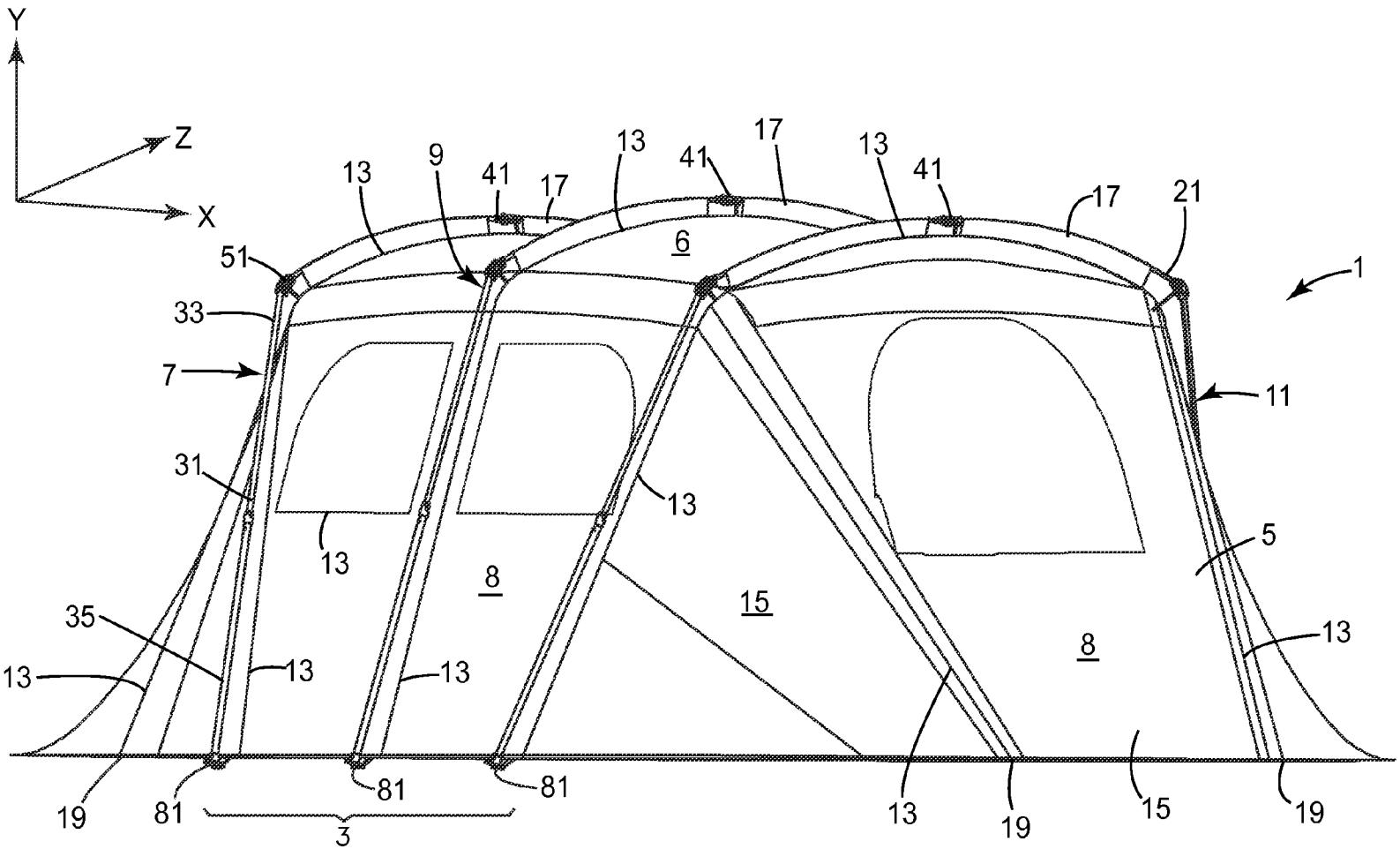
FIG. 1 is a perspective view of the foldable tent of the present invention in an open configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. The article "a" is intended to include one or more items. Where only one item is intended, the term "one" or similar language is used. Additionally, to assist in the description of the present invention, words such as top, bottom, front, rear, right and left are used to describe the accompanying figures. The terminology includes the words above specifically mentioned, derivatives thereof, and words of similar import.

Referring to FIG. 1, a foldable tent 1 of the present invention is shown in a fully open configuration. The foldable tent 1 generally includes a frame assembly 3 and a cover 5 attached to the frame assembly 3. In the preferred embodiment, the frame assembly 3 includes three substantially identical frame members 7, 9, 11—one inner frame member 9 and two outer frame members 7, 11—and each frame member 7, 9, 11 is independent and detached from each other. Manufacturing costs are reduced due to the conformity of parts required for the frame members 7, 9, 11. In the preferred embodiment, each outer frame member 7, 11 is equidistant from the inner frame member 9. The inner frame member 9 is substantially upright while each outer frame member 7, 11 rests at an angle such that the apex of the inner frame member 9 is higher than the apex of the outer frame members 7, 11. The height difference between the inner frame member 9 and the outer frame members 7, 11 forms a decline on a top section of the cover 6, which facilitates a downward run off, thus preventing any accumulation of water or debris on the top section of the cover 6.

One of ordinary skill in the art will recognize that more than three frame members could be included in the frame assembly without departing from the spirit and scope of the present invention. Furthermore, the distance separating the frame members 7, 9, 11 as well as the height difference between the frame members 7, 9, 11 could vary.

Referring to FIGS. 7-10, each frame member 7, 9, 11 includes an upper frame member 21 and a pair of side frame members 31. The upper frame member 21 includes a first pole section 23 and a second pole section 25, and each pole section 23, 25 has an inner end 27 and an outer end 29. In the preferred embodiment, each section 23, 25 is a substantially hollow, tubular pole constructed of reinforced fiberglass for increased flexibility while maintaining strength, but other flexible high-strength materials could be used. The inner ends 27 of the upper frame member first and second sections 23, 25 are pivotally connected together by a lockable first pivotal coupling member or connector device 41.

FIGS. 15A-B and 16A-D show an embodiment of the first pivotal coupling member 41. This embodiment of the first pivotal coupling member 41 is described in detail in U.S. Pat. No. 7,942,159 B2 (issued May 17, 2011), which is incorporated herein by reference in its entirety. The first pivotal coupling member 41 includes a female component B1 and a male component B2. The female and male components B1, B2 are preferably formed of a tough, molded plastic but can also be constructed with other high-strength, light-weight materials and by other methods without departing from the spirit and scope of the invention.

Figure 15A:
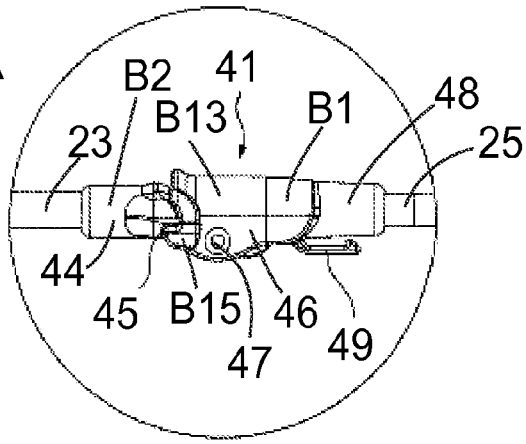
FIG. 15A is a side view of an embodiment of a first pivotal coupling member of the present invention in a locked state.
Figure 15B:
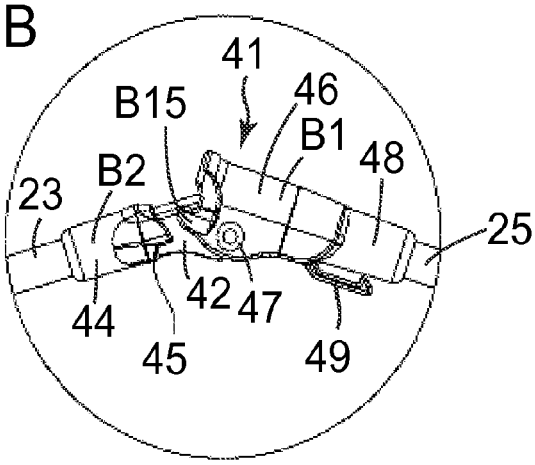
FIG. 15B is a side view of the first pivotal coupling member of FIG. 15A in an unlocked and partially folded state.

Referring to FIGS. 15A-B and 16A-D, an outer section 44 of the male component B2 includes a cavity (not shown) for receiving an inner end 27 of the upper frame member first section 23, which can be fixedly secured within the cavity by an adhesive, a fastener, form fit or any combination thereof. An opposing inner section 42 of the male component B2 includes an inner projection B21 having an elongated slot B22 having a first end 22 and a second end 24. The elongated slot B22 extends through the width of the inner projection B21. The height of the elongated slot B22 increases slightly along the length of the elongated slot B22 from the right to left. The inner projection B21 further includes an engaging extension B24 extending outward towards the female component B1. Referring to FIG. 15B, the male component B2 includes a protrusion or outer projection 45 on each outer side surface between the outer section 44 and the inner section 42. The male component also includes a hook 49 to provide a means for attaching the cover 5 to the upper frame members 21.

Referring again to 15A-B and 16A-D, an outer section 48 of the female component B1 includes a cavity (not shown) for fixedly receiving an inner end 27 of the upper frame member second section 25, which can be fixedly secured within the cavity by an adhesive, a fastener, form fit or any combination thereof. An opposing inner section 46 of the female component B1 includes a housing B13 having an upper portion 2 and two opposing side portions 4 extending downward from the upper portion 2 to form an opening B11 for receiving the inner projection B21 of the male component B2. The housing B13 also includes an inner ridge B14 extending from a back wall of the inner section 43 toward the male component B2, to form an engagement area between the inner ridge B14 and the housing upper portion 2. Referring to FIG. 16D, the inner section of the female component 46 also includes an outer ridge B15 which provides an engaging surface B16 for securely engaging the outer projection of the male component 45 when the first pivotal coupling member 41 is in a locked configuration as shown in FIG. 15A. The female and male components B1, B2 are pivotally coupled together by a fastener 47, such as a screw, metal pin, rivet or the like, which extends from each housing side portion 4 and through the elongated slot B22. The diameter of the fastener 47 is substantially similar to the height of the elongated slot B22 at the far right end of the elongated slot B22. One skilled in the art will also recognize that the female and male components B1, B2 are interchangeable such that the male component B2 could connect with the second section 25 and the female component B1 could connect with the first section 23.

Figure 16A:
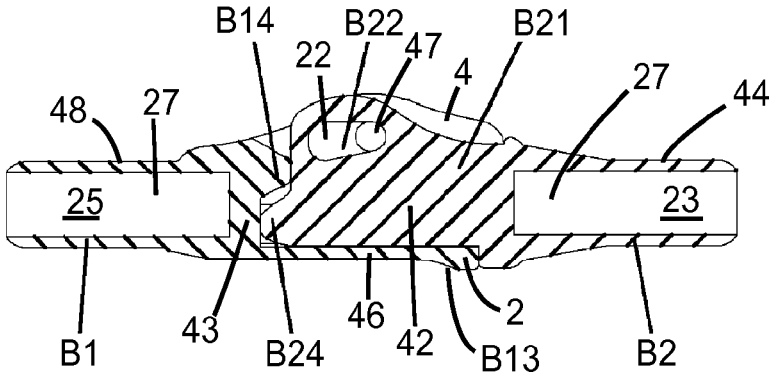
FIG. 16A is an inverted cross-sectional view of the first pivotal coupling member of FIG. 15A.

Referring to FIGS. 15A and 16A, in the locked state, the first and second sections of each upper frame member 23, 25 are substantially aligned and the female and male components B1, B2 of the first coupling member 41 are engaged and pushed toward each other. The male component B2 is shifted toward the female component B1 such that the position of the fastener 47 within the elongated slot B22 is toward the second end 24 or the outer section of the male component 44 where the height of the elongated slot B22 is substantially similar to the diameter of the fastener 47, thereby forming a frictional engagement. The male engaging extension B24 engages the back wall of the female component inner section 43 between the inner ridge B14 and the housing upper portion 2 and is also secured by frictional engagement. The male outer projection 45 also engages the female engaging surface B16 between the outer ridge B15 and the housing upper portion 2 and is further secured by frictional engagement.

Figure 9:
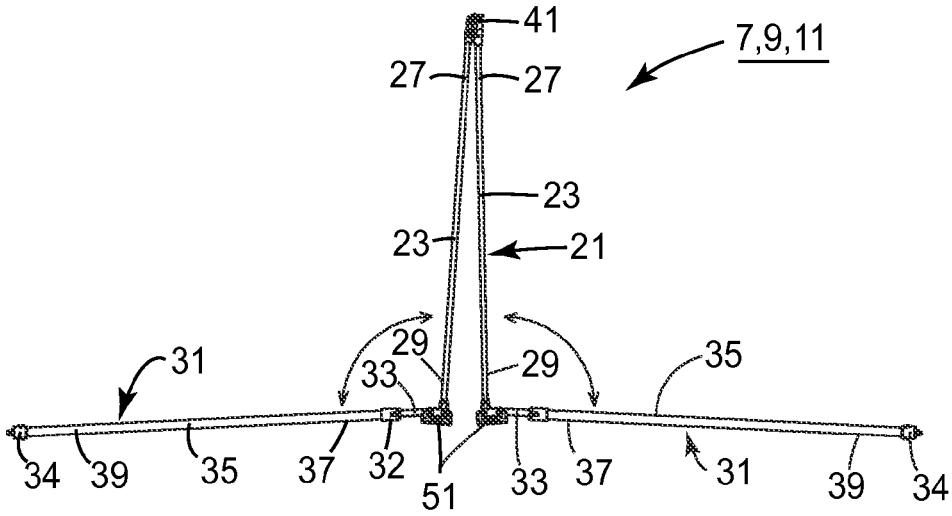
FIG. 9 is a side view of the frame member of FIG. 7 in the partially collapsed configuration shown in FIG. 2.
Figure 10:
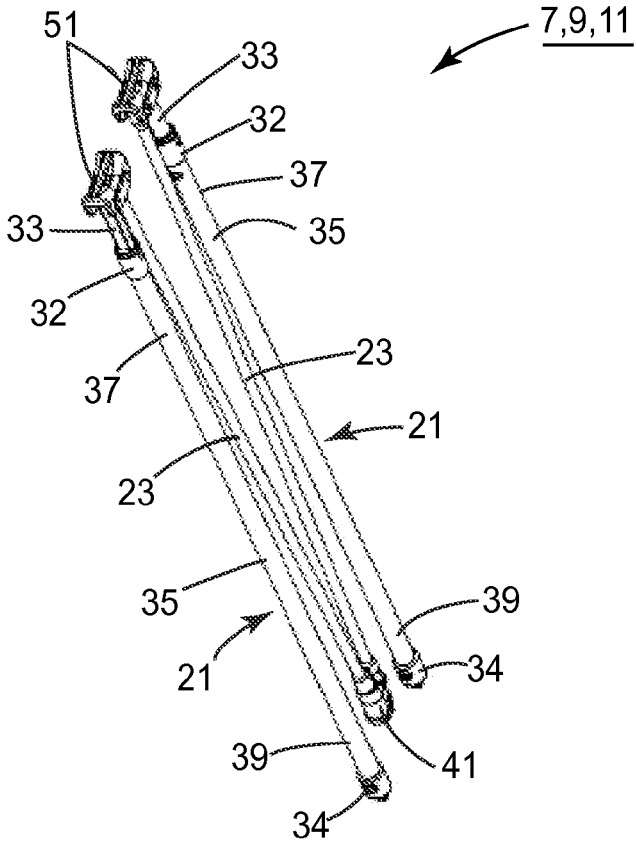
FIG. 10 is a perspective view of the frame member of FIG. 7 in a fully collapsed configuration as in FIGS. 3-6.
Figure 16B:
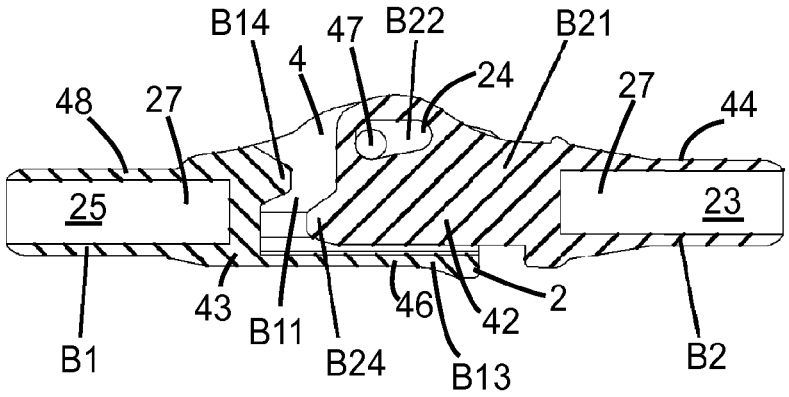
FIG. 16B is an inverted cross-sectional view of the first pivotal coupling member of FIG. 15A in an unlocked state.
Figure 16C:
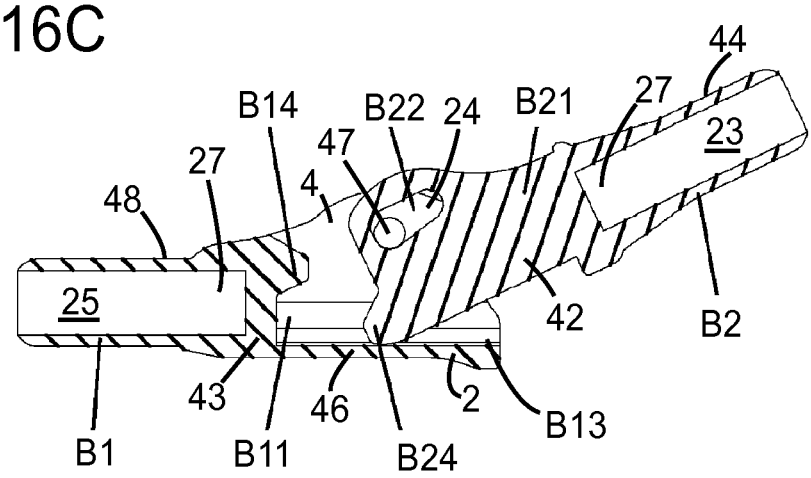
FIG. 16C is an inverted cross-sectional view of the first pivotal coupling member of FIG. 15A in an unlocked and partially folded state.
Figure 16D:
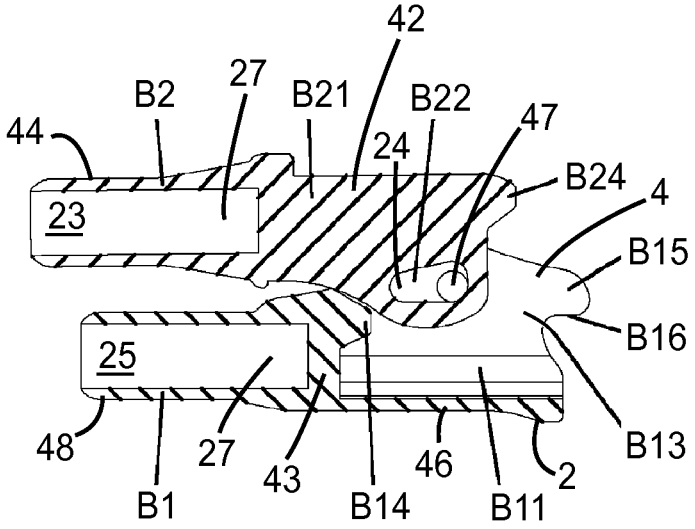
FIG. 16D is an inverted cross-sectional view of the first pivotal coupling member of FIG. 15A in an unlocked and fully folded state.

Referring to FIGS. 15B and 16B-D, the female and male components B1, B2 are unlocked by pulling the upper frame first and second sections 23, 25 away from each other. The engagement points described above are disengaged and the male component B2 is shifted away from the female component B1 such that the position of the fastener 47 within the elongated slot B22 is toward the first end 22 or the inner section of the male component 42, as shown in FIG. 16B, where the height of the slot B22 is slightly larger than that of the width at the far right end of the slot B22. The upper frame first section 23 (simultaneously with the male component B2) is then pivoted inward (toward the cover 5) 180 degrees until the female and male components B1, B2 and first and second sections 23, 25 are substantially parallel to each other as shown in FIGS. 9, 10 and 16D.

Referring to FIGS. 17-26, an alternative, preferred embodiment of the lockable first pivotal coupling member or connector device 141 is shown. The connector device 141 includes a female component A1 and a male component A2. The female and male components A1, A2 are preferably formed of a tough, molded plastic but can also be constructed with other light-weight high-strength materials and by other methods without departing from the spirit and scope of the present invention.

Figure 24:
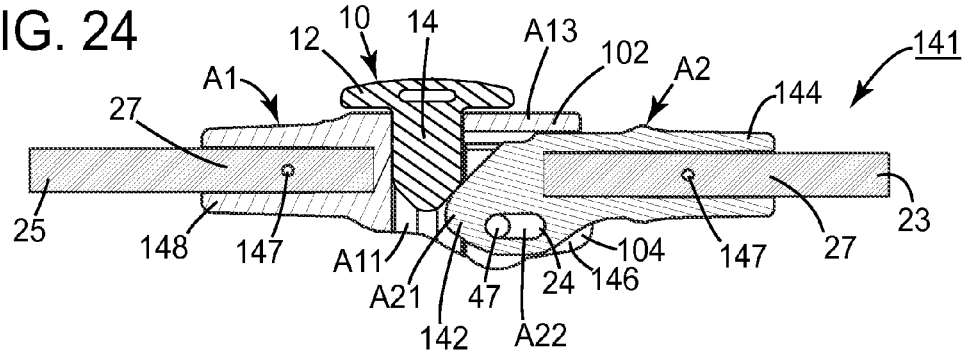
FIG. 24 is a cross-sectional view of the first pivotal coupling member of FIG. 23.
Figure 25:
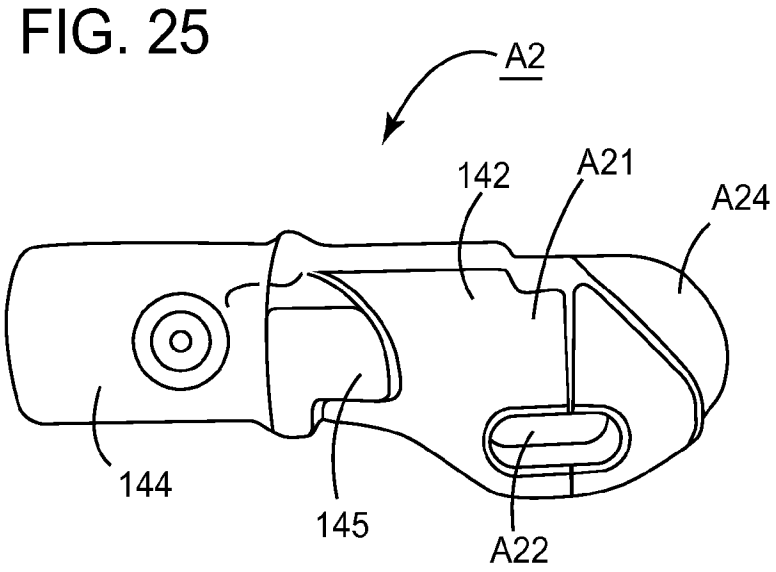
FIG. 25 is a side view of the male component of the first pivotal coupling member of FIG. 17.

Referring to FIGS. 17-25, an outer section 144 of the male component A2 includes a cavity (not shown) for receiving an inner end 27 of the upper frame member first section 23, which is fixedly secured within the cavity by a fastener 147 but other means such as an adhesive, form fit or any combination thereof could be used. An opposing inner section 142 of the male component A2 includes an inner projection A21 having an elongated slot A22 having a first end 22 and a second end 24. The elongated slot A22 extends through the width of the inner projection A21. The height of the elongated slot A22 is constant throughout the length of the slot A22 and is substantially similar to the diameter of the fastener 47. The inner projection A21 further includes an engaging extension A24 having a cammed outer surface extending axially from a center portion of the inner projection A22 towards the female component A1 as shown in FIG. 25. The male component A2 also includes a protrusion or outer projection 145 on each outer side surface between the outer section 144 and the inner section 142.

Figure 17:
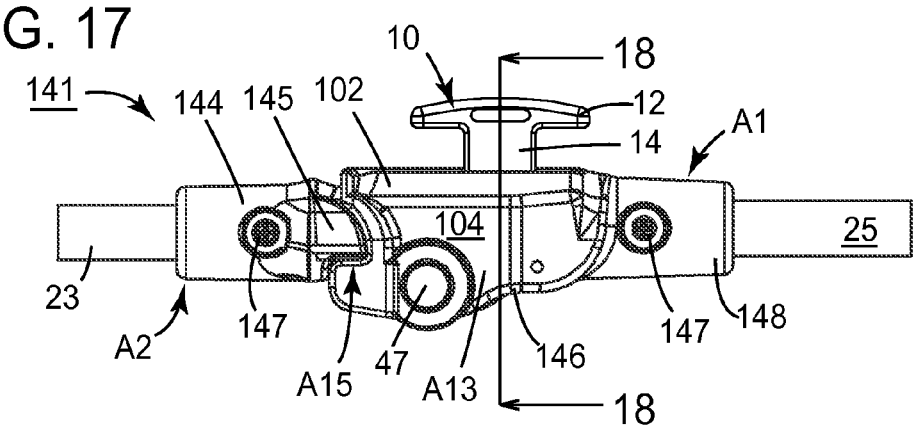
FIG. 17 is a side view of an alternative embodiment of a first pivotal coupling member of the present invention in a locked state.
Figure 21:
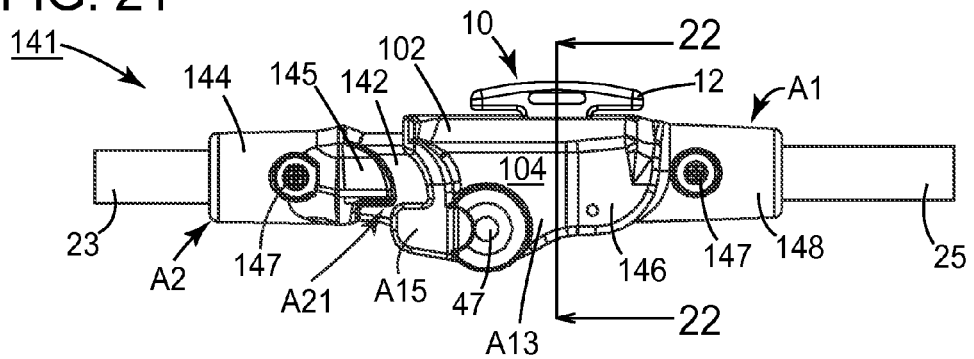
FIG. 21 is a side view of the first pivotal coupling member of FIG. 17 in an unlocked state.
Figure 26:
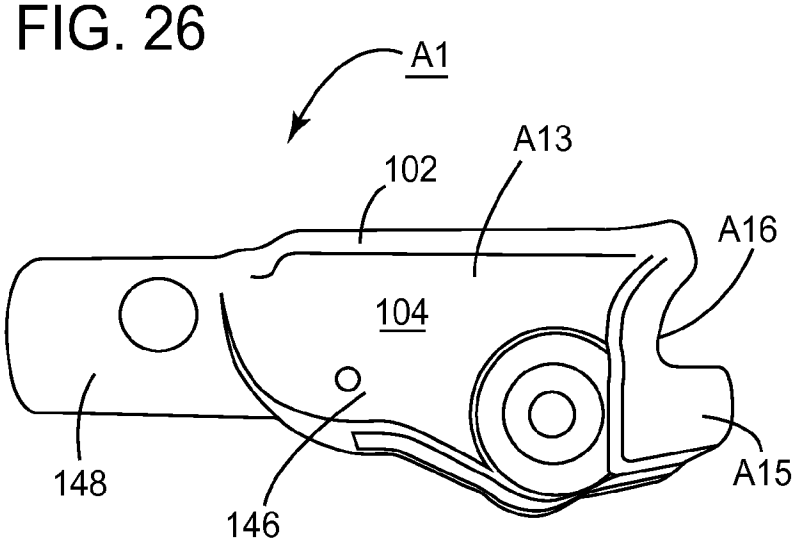
FIG. 26 is a side view of the female component of the first pivotal coupling member of FIG. 17.

Referring to 17-24 and 26, an outer section 148 of the female component A1 includes a cavity (not shown) for fixedly receiving an inner end 27 of the upper frame member second section 25, which is fixedly secured within the cavity by a fastener 147 but other means such as an adhesive, form fit or any combination thereof could be used. An opposing inner section 146 of the female component A1 includes a housing A13 having an upper portion 102 and two opposing side portions 104 extending downward from the upper portion 102 to form an opening A11 for receiving the inner projection A21 of the male component A2. The female component inner section 146 also includes an outer ridge A15 on outer sides of a distal end of the inner section 146 which provides an engaging surface A16, as shown in FIGS. 17, 21 and 26. The profile of the engaging surface A16 is substantially similar to the profile of the male component outer projection 145 such that when the connector device 141 is in a locked state, the outer projections 145 and engaging surface A16 are securely frictionally engaged as shown in FIG. 17. The housing upper portion 102 also includes an opening (not shown) for receiving a movable engaging member or push button assembly 10.

Figure 18:
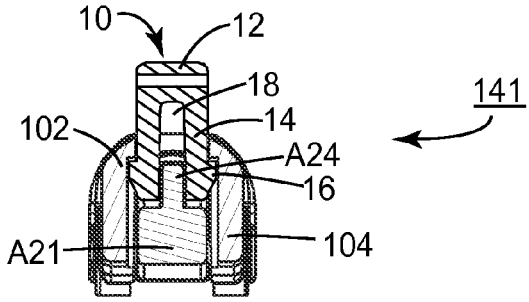
FIG. 18 is a cross-sectional view of the first pivotal coupling member of FIG. 17.
Figure 19:
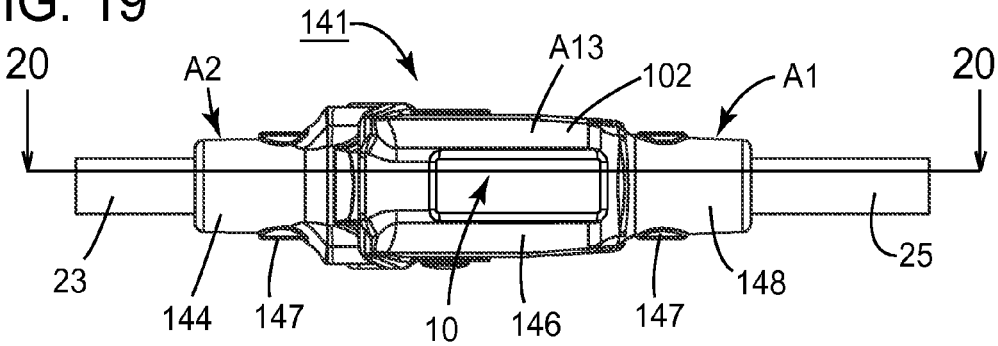
FIG. 19 is a top view of the first pivotal coupling member of FIG. 17.
Figure 20:
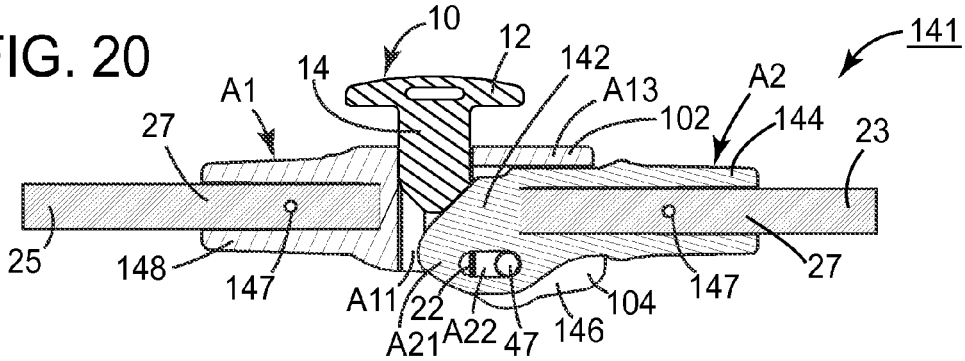
FIG. 20 is a cross-sectional view of the first pivotal coupling member of FIG. 19.
Figure 22:
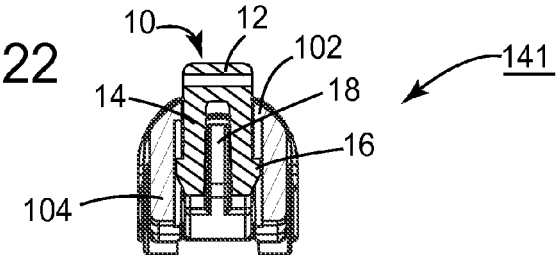
FIG. 22 is a cross-sectional view of the first pivotal coupling member of FIG. 21.
Figure 23:
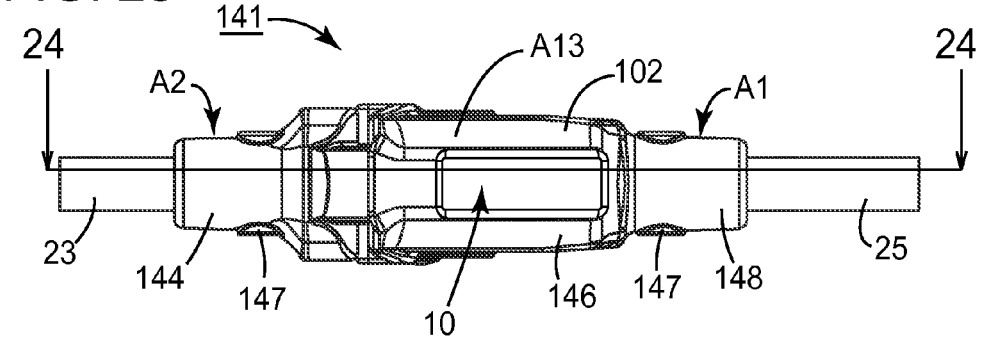
FIG. 23 is a top view of the first pivotal coupling member of FIG. 21.

Referring to FIGS. 18 and 22, the push button assembly 10 includes a push button portion 12 and a pair of spaced apart extensions 14 extending downward from each side of the push button portion 12. The spaced apart extensions 14 form a channel 18 having a width substantially similar to the width of the engaging extension A24 of the male component A2. A lower portion of each extension 14 includes a detent 16 extending from outer sides of the extensions 14. Referring to FIGS. 20 and 24, a lower edge of each extension 14 is formed at an angle corresponding to the angle of the outer edge of the male component inner projection A21 to provide smooth engagement when the push button portion 12 is engaged to lock and unlock the female and male components A1, A2, as described below.

Referring to FIGS. 20 and 24, the female and male components A1, A2 are pivotally coupled by a fastener 47, such as a screw, metal pin, rivet or the like, which extends from each housing side portion 104 and the elongated slot A22. One skilled in the art will also recognize that the female and male components A1, A2 are interchangeable such that the male component A2 could connect with the second section 25 and the female component A1 could connect with the first section 23.

In operation, referring to FIGS. 17-20, in the locked state, the first and second sections of each upper frame member 23, 25 are substantially aligned and the female and male components A1, A2 of the connector device 141 are engaged and pushed toward each other. The male component A2 is shifted toward the female component A1 such that the position of the fastener 47 within the elongated slot A22 is at a second end 24 closer to the outer section of the male component 144. Referring to FIG. 18, the male engaging extension A24 extends through the push button assembly channel 18 and engages the extensions of the push button assembly 14, thereby forming a secure frictional engagement. The upward movement of the push button assembly 10 is limited by the detents 16 which engage an inner surface of the housing top portion 102. The male outer projection 145 also engages the female engaging surface A16 between the outer ridge A15 and the housing upper portion 102 and is further secured by frictional engagement, as shown in FIG. 17.

Referring to FIGS. 21-24, the female and male components A1, A2 are unlocked by pulling the upper frame first and second sections 23, 25 away from each other or by pressing down on the push button portion of the push button assembly 12. The engagement points described above are disengaged and the male component A2 is shifted away from the female component A1 such that the position of the fastener 47 within the elongated slot A22 is at the first end 22 or toward the inner section of the male component 142 as shown in FIG. 24. The upper frame first section 23, along with the male component A2 is then pivoted inward (toward the cover 5) 180 degrees until the female and male components A1, A2 and first and second sections 23, 25 are substantially parallel to each other as shown, for example, in FIGS. 9, 10 and 16D.

One of ordinary skill in the art will recognize that modifications could be made to the first pivotal coupling members 41, 141. For example, the coupling members 41, 141 could include additional hooks or an aperture extending through the coupling members 41, 141 to provide a means for attaching the cover 5 or other accessories.

Referring to FIGS. 7-10, each side frame member 31 includes a first pole section 33 and a second pole section 35, and each section 33, 35 has an inner end 37 and an outer end 39. In the preferred embodiment, each section 33, 35 is a substantially hollow, tubular pole constructed of steel but other materials such as reinforced fiberglass or any high-strength, light-weight material could be used. The first section outer end 39 of each side frame member 31 is pivotally connected to a corresponding outer end 29 of the upper frame member 21 by a second pivotal coupling member 51.

Figure 14:
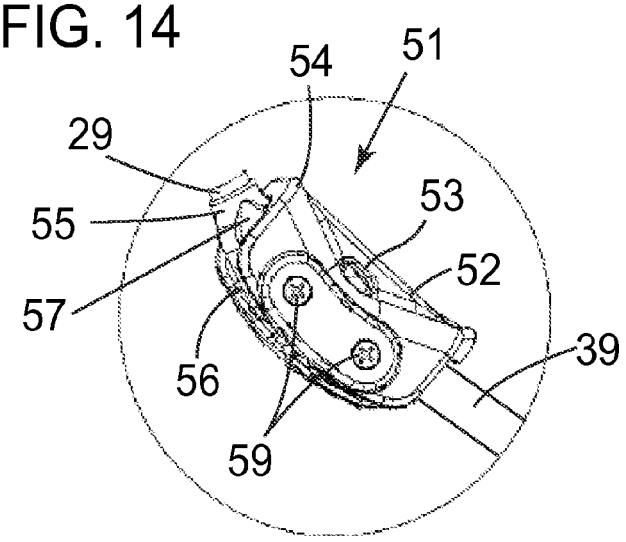
FIG. 14 is a perspective view of a second pivotal coupling member of the present invention.

Referring to FIG. 14, in the preferred embodiment, the second pivotal coupling member 51 includes a U-shaped casing 53 having an opening (not shown) along an outer side 56 for receiving an outer end 29 of each section 23, 25 of the upper frame member 21 on one end and an outer end 39 of each first section 33 of the side frame member 31 on another end. The width of the opening of the casing 53 is constant throughout the opening and is substantially similar to the diameter of the side frame member first section 33. In the preferred embodiment, a cap 55 having a protrusion 57 on opposing sides is fixedly attached to the upper frame member outer end 29 to accommodate for the smaller diameter of fiberglass poles of the upper frame member first and second sections 23, 25. The outer diameter of the cap 55 measured from the outer surfaces of the protrusions 57 is substantially similar to the width of the opening of the casing 53. Material costs are reduced by utilizing protrusions 57 to increase the diameter of the upper frame member outer ends 29, instead of using a cap having a constant larger diameter throughout the cap. The cap 55 and the outer end of each upper frame member section 29 are attached by form fit and adhesive but other means such as a fastener could be used for the attachment. The cap 55 of the upper frame member first section outer end 29 and the side frame member first section outer end 39 are attached to the casing 53 by a fastener 59 for pivotal engagement. The casing 53 and cap 55 are preferably formed of a tough, molded plastic but can also be constructed with other light-weight, high-strength materials and by other methods without departing from the scope of the invention. In the preferred embodiment, the fastener 59 is a metal screw but other types of fasteners such as a metal pin or rivet could be used. The casing 53 further includes a hook 52 extending longitudinally from each end of the casing 53 along an inner side 54. The hook 52 faces inward towards the cover 5 and is used as an attaching means for the cover 5. The casing inner side 54 could also include an aperture extending through the casing 53 for attaching the cover 5. In operation, in the open configuration of the tent 1, the outer ends 29 (with cap 55) and 39 of each corresponding section 23 (or 25) and 33, respectively, is disposed within the opening of the casing 53 and is secured by frictional engagement between the protrusions 57 and an inner side surfaces of the casing 53, and the side frame member first section outer end 39 and the inner side surfaces of the casing 53. In the collapsed configuration, the outer ends 29 (with cap 55) and 39 are disengaged from the casing 53 and the corresponding sections 23 (or 25), 33 are pivoted outwardly through the opening of the casing 53 to a substantially parallel configuration as best shown in FIG. 10.

Figure 7:
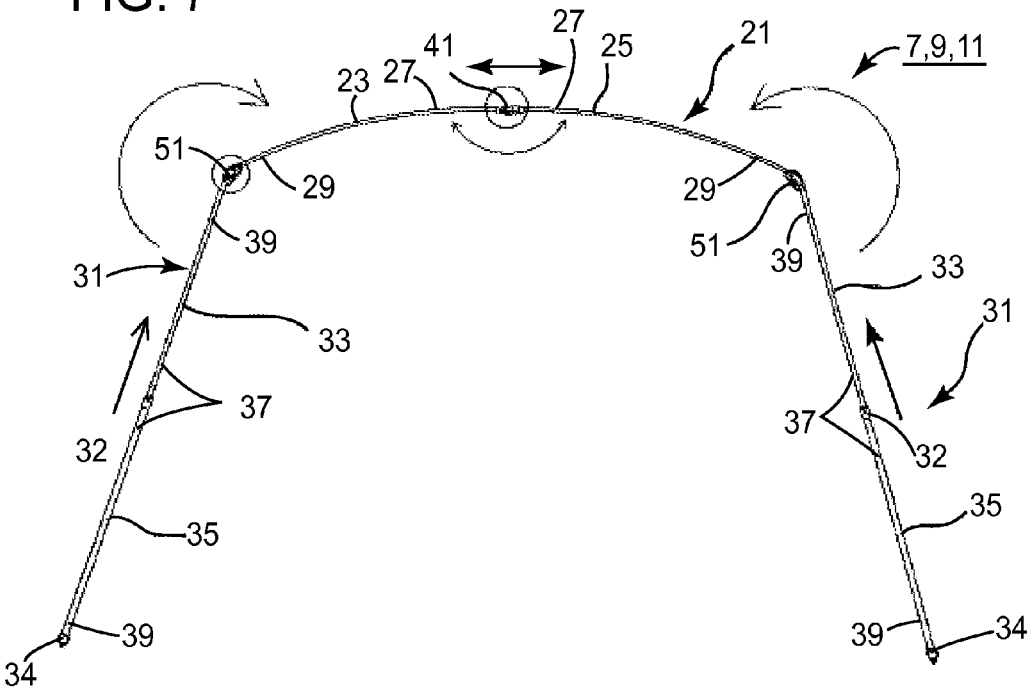
FIG. 7 is a side view of a frame member of the foldable tent of FIG. 1 in an open configuration as also shown in FIG. 1.
Figure 8:
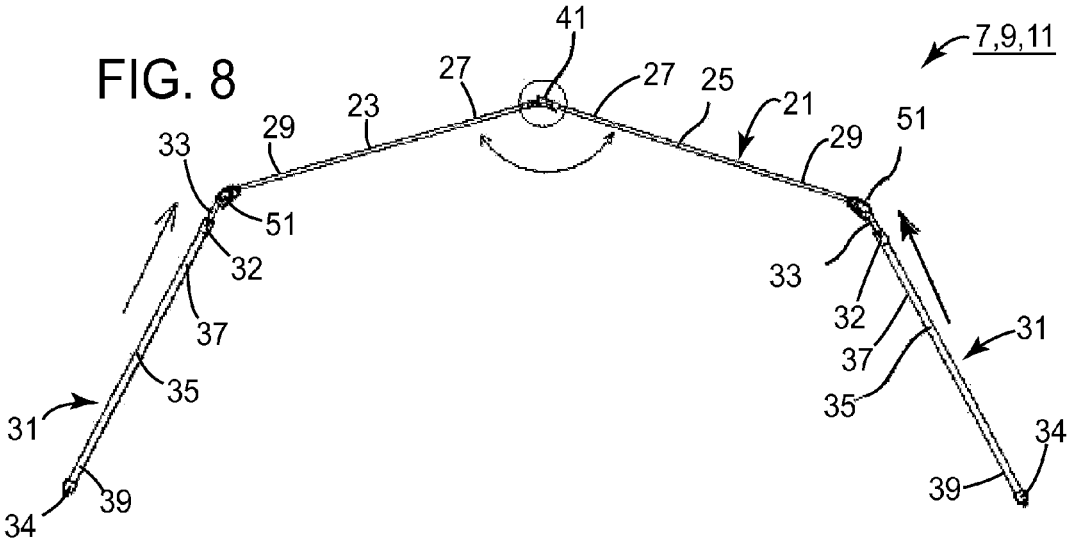
FIG. 8 is a side view of the frame member of FIG. 7 with the side frame members in a retracted position.

Referring again to FIGS. 7-10, the first and second sections 33, 35 of each side frame member 31 are slidingly coupled together. In the preferred embodiment, the inner diameter of the second section 35 is substantially similar to the outer diameter of the first section 33 such that the first section 33 is telescopically slidable within the second section 35. The inner end of the first section 33 is provided with a locking member 32. Each telescoping second section 35 includes a spring loaded detent pin (not shown) for indexing in apertures (not shown) provided in each corresponding first section 33 for locking the sections 33, 35 in an extended position as shown in FIG. 7, and depressing the detent pin to disengage the apertures to unlock and retract the second section 35 as shown in FIGS. 8-10. It is preferred that the length of the second section 33 is substantially similar to the length of the first section 33 such that when retracted substantially all of the first section 33 is stored within the second section 35. Each outer end 39 of the side frame second section 35 may also include an end cap 34 for engagement with a coupling extension 81 which is described in more detail below.

One of ordinary skill in the art will recognize that multiple spring loaded detent pin-aperture combinations could be included in each side frame member section 33, 35 such that the sections 33, 35 could be adjusted to different lengths. It will also be recognized that any other conventional means for connecting the side frame member sections 33, 35 could be used, including but not limited to other slidable and pivotal connections.

Figure 11:
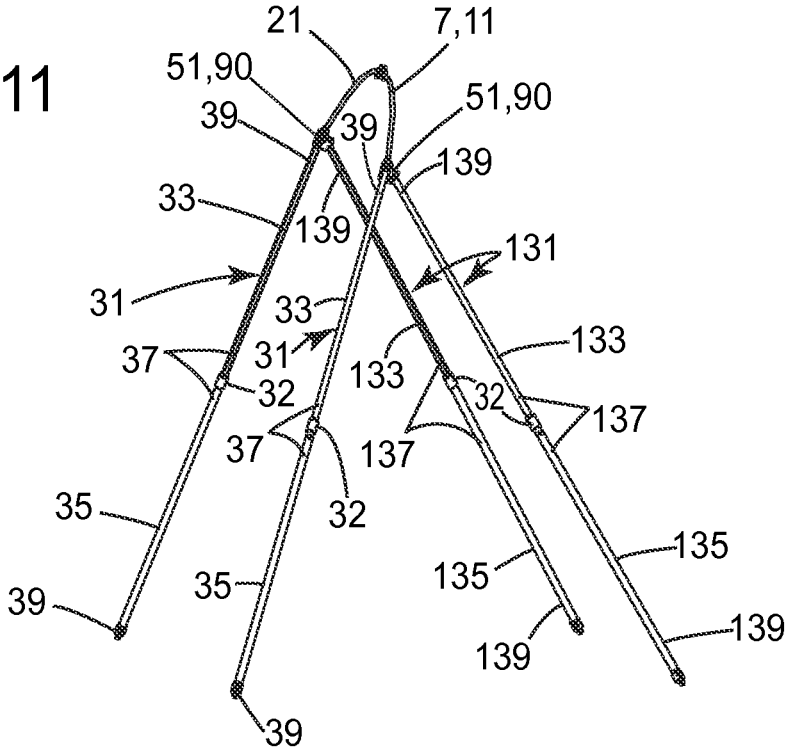
FIG. 11 is a perspective view of an alternative embodiment of a frame member of the present invention.

Referring to FIG. 11, an alternative embodiment of the outer frame members 7, 11 is shown. In this embodiment, the outer frame members 7, 11 are provided with a pair of auxiliary poles 131 for additional support to the overall structure of the foldable tent 1. Each auxiliary pole 131 is configured substantially similarly to the side frame members 31 as described above. That is, each auxiliary pole 131 includes first and second pole sections 133, 135 each having an inner end 137 and an outer end 139. The first and second sections 133, 135 are telescopically connected, and the outer ends 139 of each first section 133 are pivotally connected to each outer frame member 7, 11 at or near each corresponding side frame member first section 33 outer end 39. In the open configuration of the tent 1, each auxiliary pole 131 extends along a corner seam 13 bridging two side walls 8 and each second section 135 outer end 139 is coupled to a coupling extension 81 (described below) located at corresponding corners of the cover bottom section 28. To collapse the auxiliary poles 131, the auxiliary poles 131 are disengaged from the coupling extensions 81, each auxiliary pole 131 is collapsed as described above with respect to the side frame members 31 and are pivoted inwardly and aligned with corresponding side frame members 31.

Figure 12:
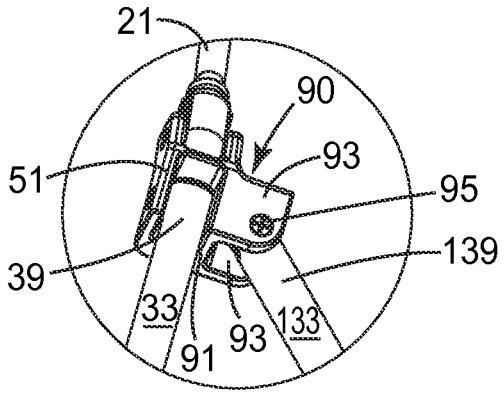
FIG. 12 is a perspective view of an embodiment of a third pivotal coupling member of the frame member of FIG. 11.

Referring to FIG. 12, to couple the auxiliary poles 131 to the outer frame members 7, 11, in one embodiment, a side portion of the second pivotal coupling member 51 includes a third pivotal coupling member or U-shaped connector 90 having a rear wall 91 and a pair of spaced apart side walls 93 extending outwardly to form a recess (not shown) for receiving the outer end 139 of the auxiliary pole first section 133. The U-shaped connector 90 is integral to the second pivotal coupling member 51 and is preferably formed of a tough, molded plastic but can also be constructed with other high-strength, light-weight materials and by other methods without departing from the scope of the invention. The outer end 139 of each auxiliary pole first section 133 is pivotally connected to the U-shaped connector 90 by a fastener 95 which extends through the auxiliary pole first section 133 and through each side wall 93. In the preferred embodiment, the fastener 95 is a metal screw but other types of fasteners such as a metal pin or a rivet could be used.

Figure 13:
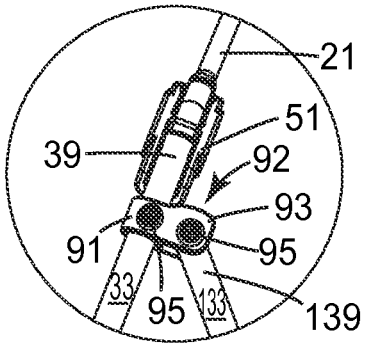
FIG. 13 is a perspective view of another embodiment of a third pivotal coupling member of the frame member of FIG. 11.

Referring to FIG. 13, in another embodiment of a third pivotal coupling member, the outer end 139 of each auxiliary pole first section 133 is pivotally connected to the side frame member first section 33 by an independent connector assembly 92. In this embodiment, the connector assembly 92 is substantially U-shaped and includes a curved rear wall 91 and a pair of spaced apart side walls 93 extending outwardly therefrom to form a recess (not shown) for receiving the outer end 39 of the side frame member first section 33 as well as the outer end 139 of the auxiliary pole first section 133. The connector assembly 92 is preferably formed of a tough, molded plastic but can also be constructed with other high-strength, light-weight materials and by other methods without departing from the scope of the invention. The outer end 39 of the side frame member first section 33 is disposed against the curved rear wall 91 and adjoining side wall portions 93, and is fixedly attached thereto by a fastener 95 which extends through the side frame member first section 33 and through each side wall 93. The outer end 139 of each auxiliary pole first section 133 is pivotally connected to the connector assembly 92 by a fastener 95 which extends through the auxiliary pole first section 133 and through each side wall 93. In the preferred embodiment, the fastener 95 is a metal screw but other types of fasteners such as a metal pin or a rivet could be used.

One of ordinary skill in the art will recognize that the number of frame members, the number of sections of each frame member, as well as the folding methods of the frame members could vary without departing from the spirit and scope of the invention. It is also possible to add further extensions and additional auxiliary poles to the frame members to provide more stability to the overall structure of the foldable tent.

Referring to FIGS. 1-6, the cover 5 of the foldable tent 1 includes a plurality of cover members fixedly attached together by conventional sewing methods, to form an enclosed shelter having a top section 6, bottom section 28 and plurality of side sections 8. The cover 5 includes an inner surface (not shown) and an outer surface 15. In the preferred embodiment, the cover 5 is water and flame resistant, and is a fabric constructed from materials such as cotton, polyester or nylon, or any combination thereof. The cover 5 can also be constructed with heat reflecting material and other materials could be used for the cover 5 without departing from the spirit and scope of the invention. In the preferred embodiment, the bottom section of the cover 28 extends further outward than the top section of the cover 6 such that the side sections of the cover 8 are formed on an incline. The incline ensures that any water or debris will not accumulate on the cover 5 and instead will travel toward the bottom of the tent 1 to the surface. The adjoining cover members form seams 13 throughout the cover 5 and additional seams 13 are formed from adjoining sections that form the windows and doors. A continuous flexible adhesive tape (not shown) is applied to the seams 13 on the inner surface of the cover 5 to prevent rain water, other liquids or debris from penetrating the cover 5 through the seams 13 from the outer surface 15. In the preferred embodiment, frame members 7, 9, 11 are generally aligned with the vertical seams 13 of the side sections of the cover 8 and the horizontal seams 13 of the top section of the cover 6. In the preferred embodiment, the top section of the cover 5 is attached to the upper frame members 21 by a plurality of sleeves 17 which are attached at the horizontal seams 13 of the top section of the cover 6 by conventional sewing methods. The sleeves 17 extend along the entire length of each upper frame member 21 except where the first pivotal coupling member 41, 141 is located. One of ordinary skill in the art will recognize that the sleeves could be replace by a plurality of hooks or other attachment means without departing from the spirit and scope of the invention. Other portions of the cover 5 could be attached to the frame assembly 3 by additional hooks or other attachment means as well. The cover 5 could also be provided with a plurality of attachment means, e.g., a string made of high-strength material, to attach to hooks or apertures provided on the first pivotal coupling member. One of ordinary skill will recognize that other components or accessories, such as a rain fly or any other modification to the inner and outer surfaces of the cover, such as a door mat extension 99 shown in FIG. 3, could be added to the foldable tent 1 of the present invention.

Figure 27:
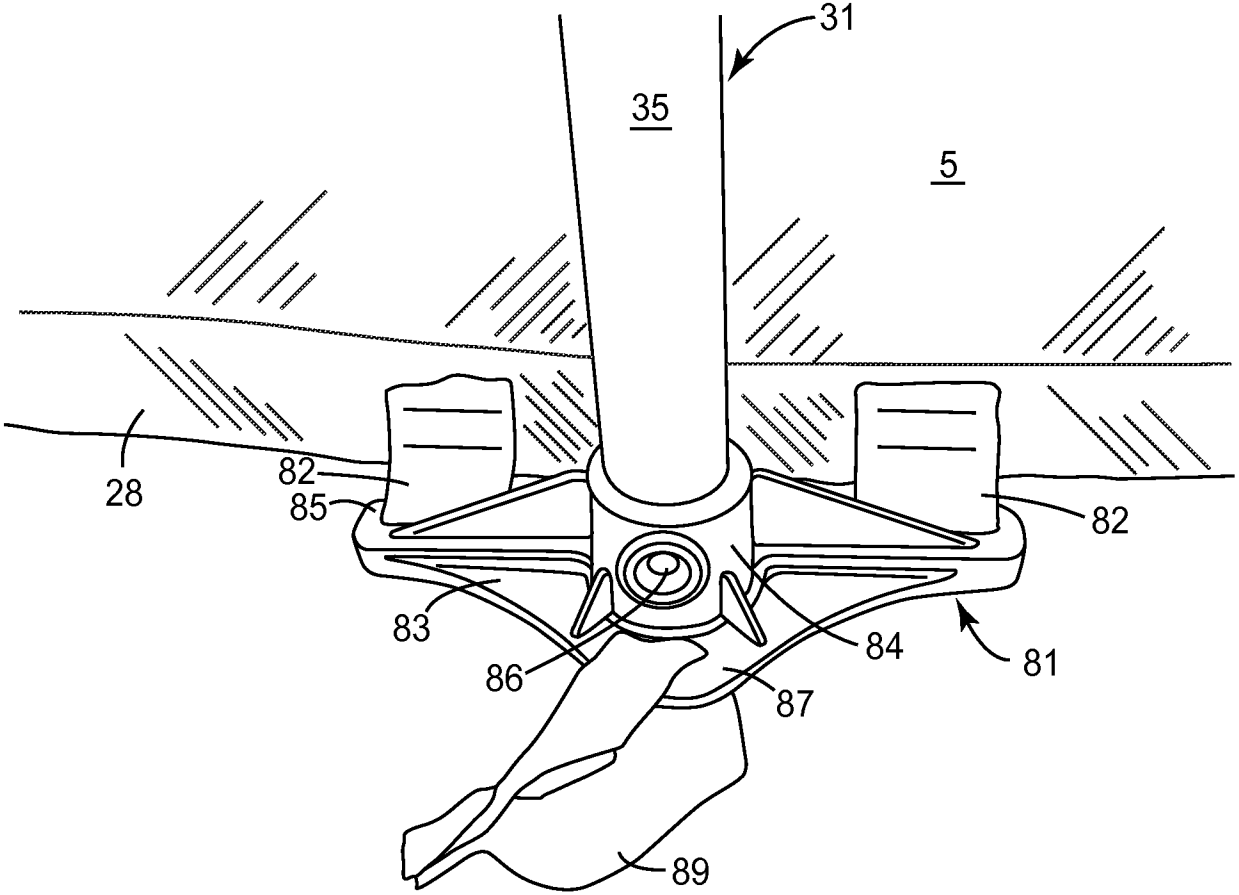
FIG. 27 is a perspective view of a coupling extension fixed to a bottom section of the cover of the foldable tent of the present invention.

Referring to FIG. 27, the bottom portion of the cover 28 includes a plurality of coupling extensions 81 for further securing the frame assembly 3 to the cover 5. The bottom portion of the cover 28 is constructed of a tough, water resistant polyethylene material. The coupling extension 81 includes a housing portion 83, formed of a tough, molded plastic, having a substantially cylindrical extension or pole receiving member 84 extending upwardly for receiving the side frame member second section 35 outer end. The cylindrical extension 84 includes an aperture 86 for receiving a fastener for fixedly attaching the side frame member second section 35 outer end 39 to the coupling extension 81. The housing portion 83 also includes a pair spaced apart of slots (not shown) at an inner end of the housing portion 85, as well as a slot (not shown) at an outer end of the housing portion 87. An outer strap 89 formed of a woven nylon material is attached to the single slot at the outer end of the housing portion 85 to accommodate for stakes (not shown) to secure the tent 1 to a surface. An inner strap or connector 82 is coupled to each slot at the inner end of the housing portion 85 and is further coupled to the bottom portion of the cover 5 by conventional sewing methods. The multiple inner straps 82 prevent the coupling extension 81 from rotating during storage and transport, thereby eliminating any adjustments that may have to be made when erecting the tent 1. Referring to FIG. 1-6, each corner of the cover 19 also includes a strap 89 extending from the cover bottom portion 28 to accommodate for stakes (not shown) to secure the tent 1 to a surface. The corner straps 89 could be replaced by coupling extensions 81 to receive the auxiliary poles 131, if they are used with the outer frame members 7, 11 as shown in FIG. 11.

Figure 2:
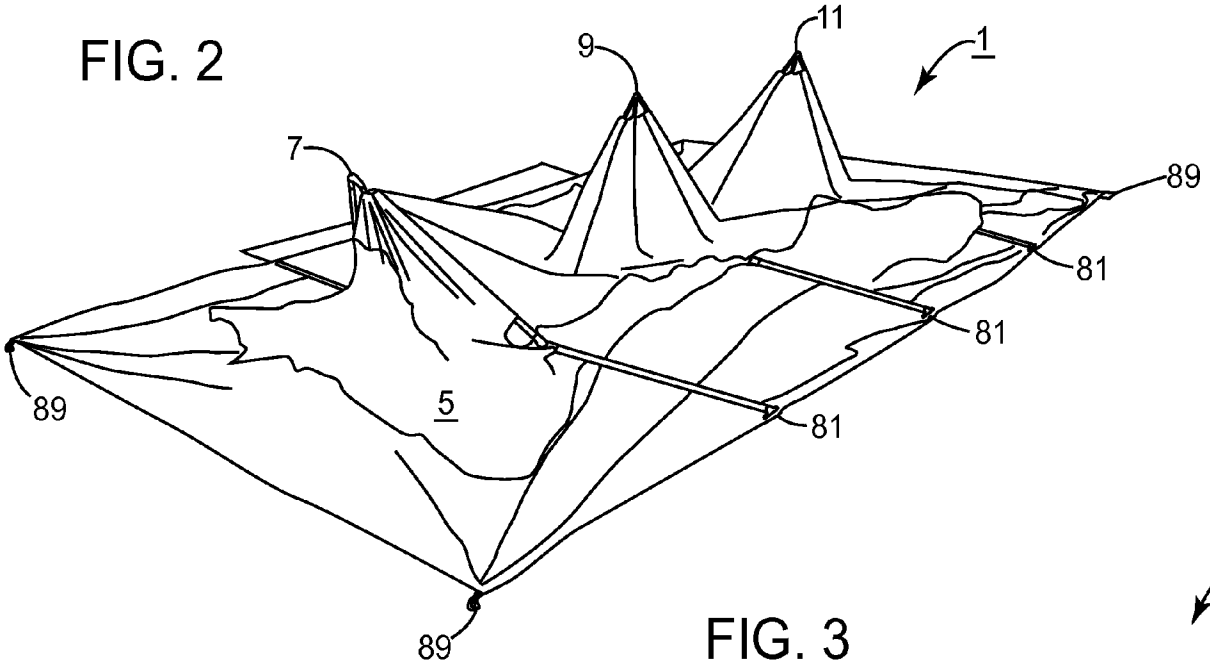
FIG. 2 is a perspective view of the foldable tent of FIG. 1 with the frame assembly in a partially collapsed configuration.

In operation, referring to FIGS. 1-10, the foldable tent 1 is erected by unfolding the cover 5 and frame assembly 3 as shown in FIGS. 2-6. Each corner of the cover 19 is extended until the cover bottom section 28 is fully expanded and taut, and stakes are applied to the straps 89 of each corner of the cover 19 to secure the cover 5 to a surface. Stakes can also be applied to the straps 89 of each coupling extension 81. Each frame member 7, 9, 11 is positioned in a substantially upright position as shown in FIGS. 2 and 8. The side frame member first section 33 is extended from the side frame member second section 35 and the two sections 33, 35 are locked in an extended configuration as shown in FIG. 7. The upper frame member first and second sections 23, 25 are aligned and pushed toward each other to lock the first pivotal coupling member 41 or 141 of the upper frame member 21 into a locked state as shown in FIG. 7, 15A, 17. Once the frame members 7, 9, 11 are extended and locked the top and side sections of the cover 6, 8 become taut due to the geometrical constraints of the overall configuration of the tent 1 as shown in FIG. 1. The cover 5 exerts a generally downward and inward force on the frame assembly 3 which aides in maintaining the tent 1 in the open configuration. Referring to FIG. 1, in the open configuration, the first pivotal coupling members 41 are aligned along a common first x-y plane and the second pivotal coupling members 51 on each side of the tent 1 are also aligned in common second and third x-y planes.

Figure 3:
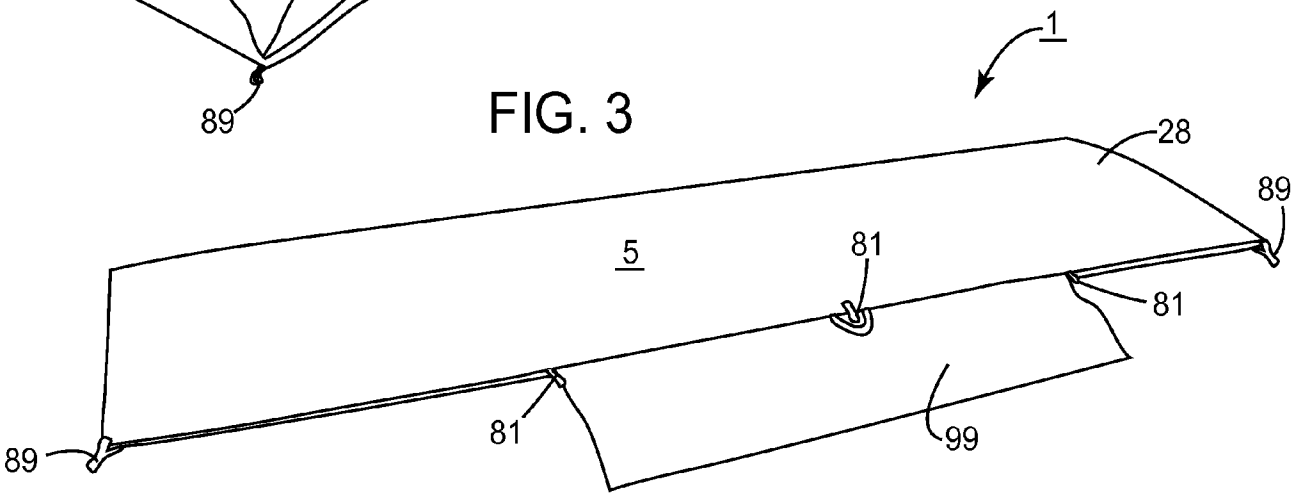
FIG. 3 is a perspective view of the foldable tent of FIG. 1 in a first partially folded configuration.
Figure 4:
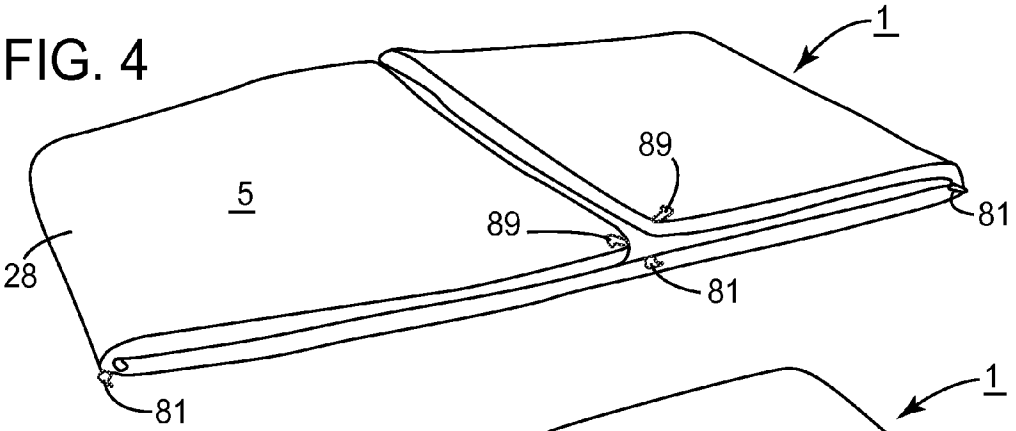
FIG. 4 is a perspective view of the foldable tent of FIG. 1 in a second partially folded configuration.
Figure 5:
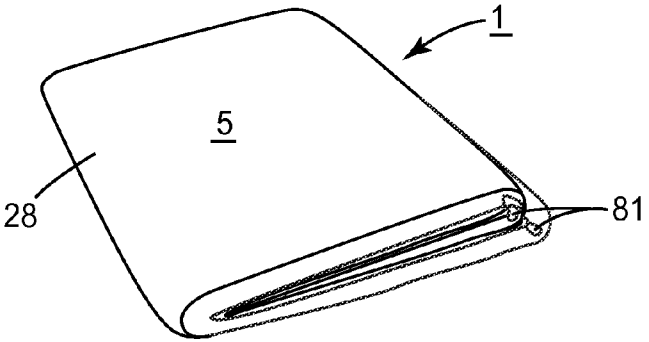
FIG. 5 is a perspective view of the foldable tent of FIG. 1 in a third partially folded configuration.
Figure 6:
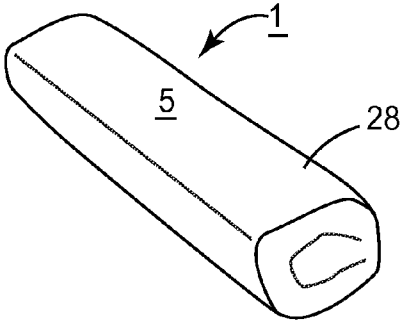
FIG. 6 is a perspective view of the foldable tent of FIG. 1 in a fully folded configuration.

Referring to again to FIGS. 1-10, the tent 1 is folded in reverse order as described above culminating in a compact folded configuration as shown in FIG. 6. That is, the frame members 7, 9, 11 are collapsed and the cover 5 is folded in half along a central longitudinal axis as shown in FIG. 3, as each frame member 7, 9, 11 is collapsed to a fully collapsed state as shown in FIG. 10. At this time, each collapsed frame member 7, 9, 11 extends across the width of the outer surface of the cover 15. The cover 5 is then folded along axes formed by the collapsed outer frame members 7, 11 as shown in FIG. 4, and folded again along an axis formed by the collapsed inner frame member 9 as shown in FIG. 5. The cover is then rolled into a compact bundle as shown in FIG. 6. These systematic folding steps allow the tent 1 to be consistently folded into a tight, compact bundle to minimize storage space.

Figure 28A:
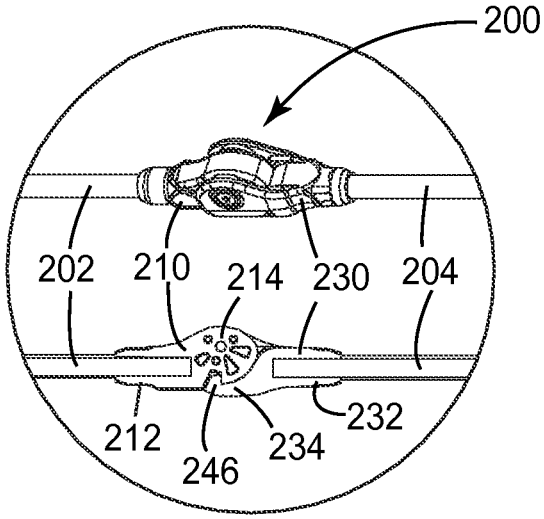
FIG. 28A is a perspective view and a sectional view of an alternative embodiment of a connector device or pole joint of the present invention in an aligned configuration.
Figure 28B:
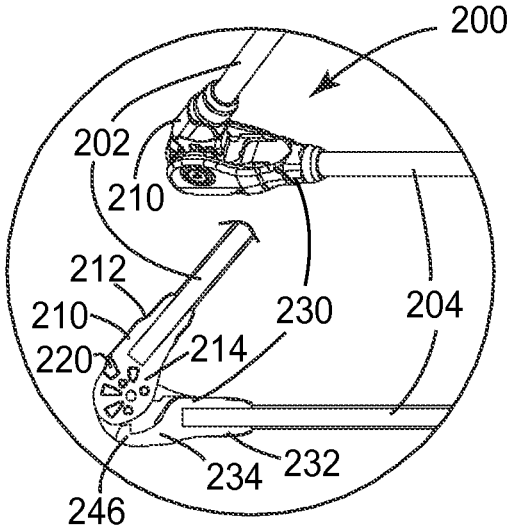
FIG. 28B is a perspective view and a sectional view of the connector device or pole joint of FIG. 28A in a partially folded configuration.
Figure 28C:
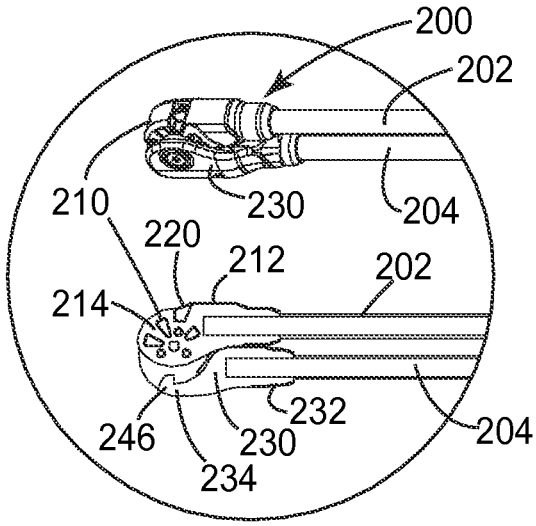
FIG. 28C is a perspective view and a sectional view of the connector device or pole joint of FIG. 28A in a folded configuration.

Referring to FIGS. 28A-30B, an alternative embodiment of a connector device or pole joint 200 is shown. In general, the connector device 200 includes a male component 210 pivotally coupled to a female component 230, which retain a pair of tent poles 202, 204 such that the poles 202, 204 are pivotally coupled when the poles 202, 204 are aligned in an aligned configuration as shown in FIG. 28A; when the poles 202, 204 are partially folded as shown in FIG. 28B; and when the poles 202, 204 are folded 180 degrees substantially parallel and adjacent to each other in a folded configuration as shown in FIG. 28C.

Figure 29A:
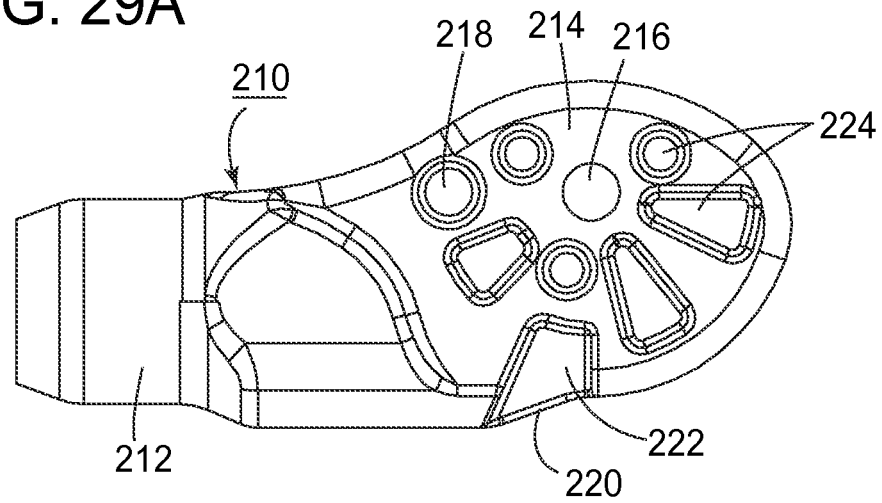
FIG. 29A is a side view of a male component of the connector device or pole joint of FIG. 28A.
Figure 29B:
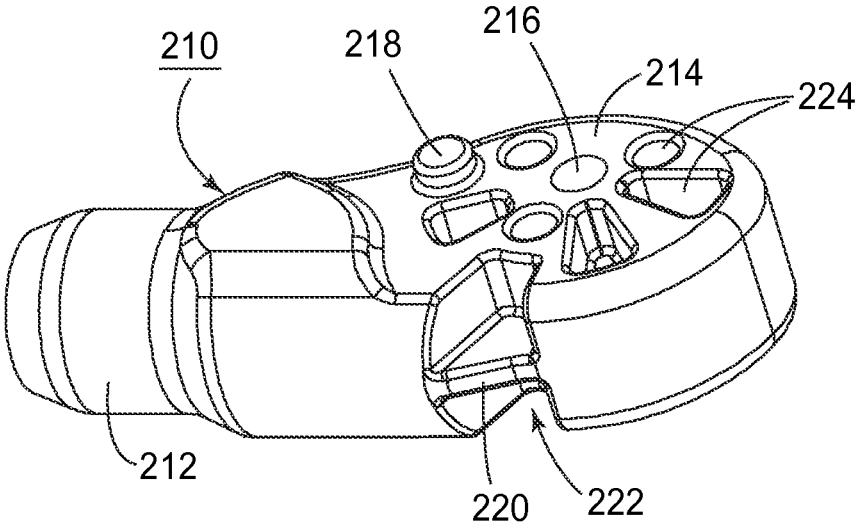
FIG. 29B is a bottom perspective view of the male component of FIG. 29A.

Referring to FIGS. 29A-B, the male component 210 includes an outer section 212 having a first cavity for receiving an end of one of the poles 202 and an opposing inner section 214 having an inner projection. The pole 202 could be coupled to the cavity via fastener, adhesive or a combination of both. The inner projection includes a first pivoting hole 216 extending axially through the inner projection. A guide pin 218 integrally formed on the inner projection extends axially outwardly at an upper portion of each side of the inner projection. In the preferred embodiment, the guide pin 218 is substantially cylindrical but the guide pin 218 could take on other shapes as well. The male component 210 also includes a first locking member 220 extending from a bottom portion of the inner projection. In the preferred embodiment, the first locking member 220 is an extension 222 extending from a center bottom portion of the inner projection and is formed integrally thereto. The extension 222 is formed between indents on each side of the inner projection 214. However, the extension 222 could be replaced with an axially extending void and a bar extending longitudinally at a lower end of the inner projection 214. The inner projection also includes a plurality of axial openings, voids or indents 224 on each side of the inner projection. The male component 210 is integrally formed with a hard molded plastic and the openings 224 are included to reduce manufacturing costs on material, especially for larger connector devices used for larger tents to accommodate for larger poles, without compromising the strength and durability of the male component 210.

Figure 30A:
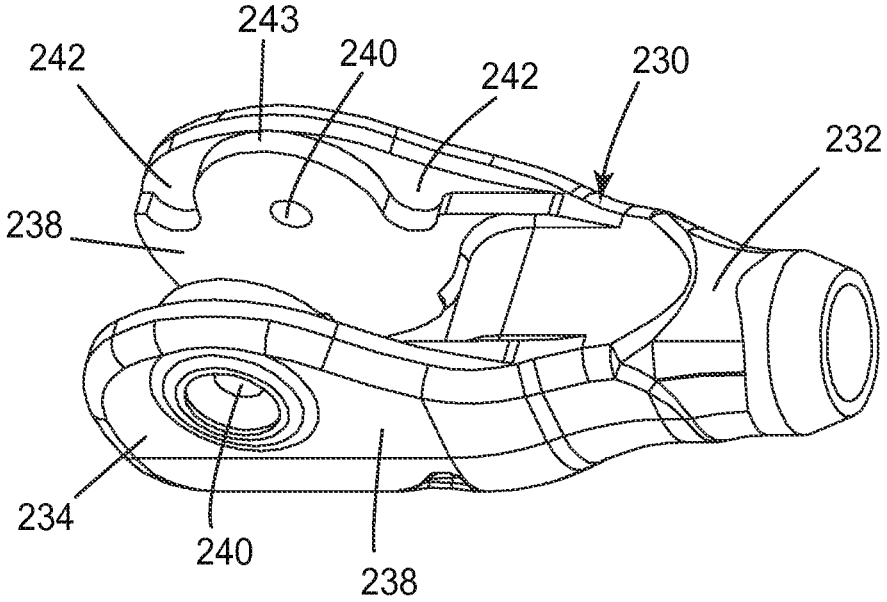
FIG. 30A is a top perspective view of a female component of the connector device or pole joint of FIG. 28A.
Figure 30B:
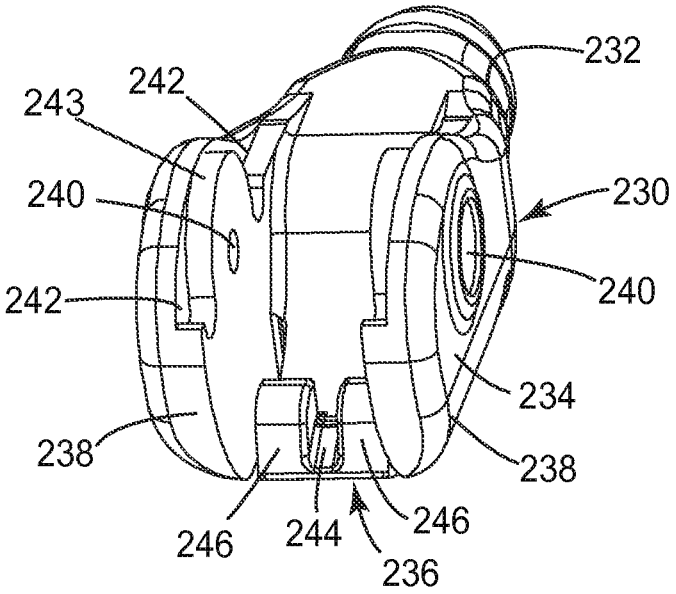
FIG. 30B is a side perspective view of the female component of FIG. 30A.
Figures 31A, 31B, 31C:
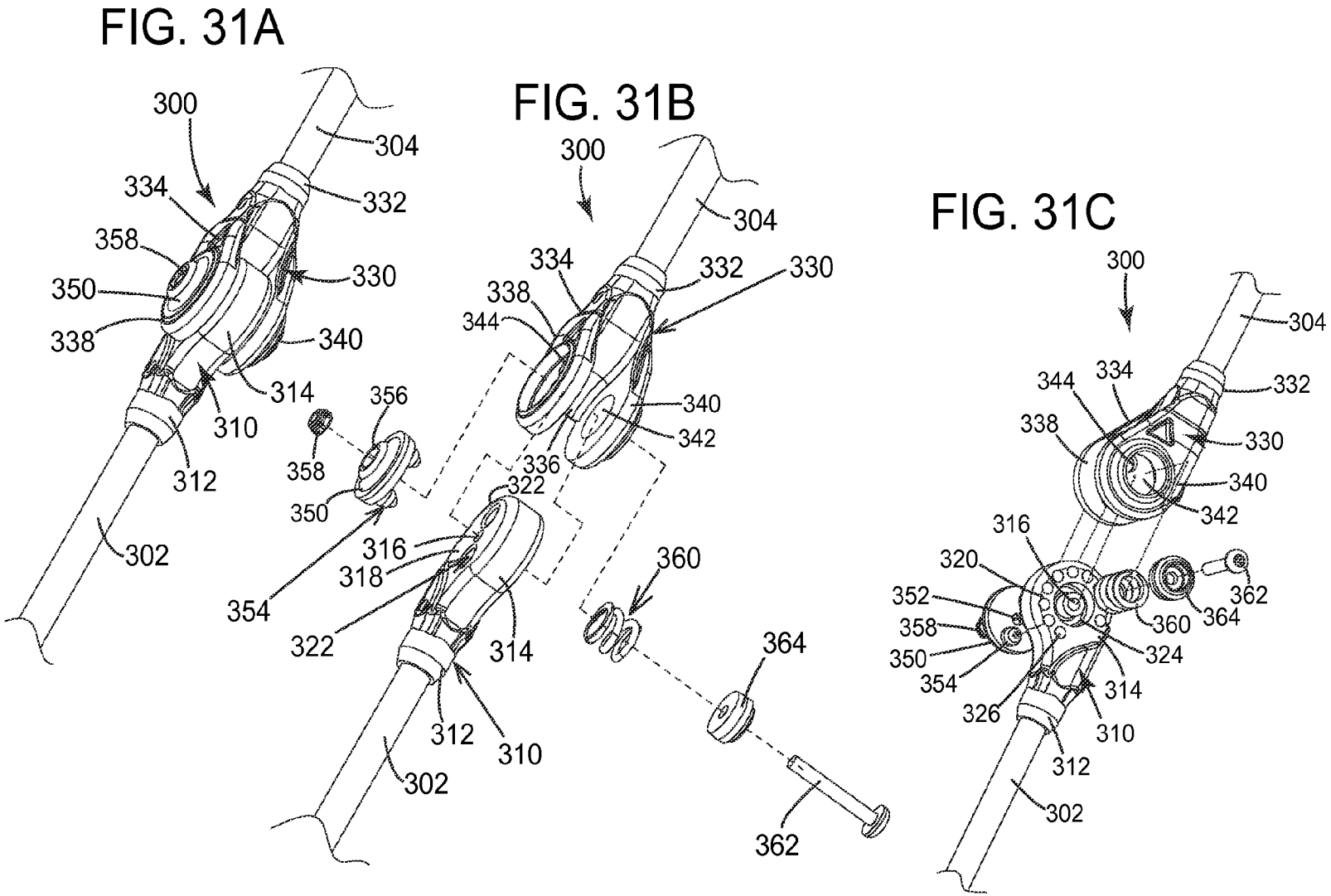
FIG. 31A is a top, left perspective view of an alternative embodiment of a connector device or pole joint of the present invention in an aligned configuration.
FIG. 31B is an exploded view from a top, left side of the connector device or pole joint of FIG. 31A.
FIG. 31C is an exploded view from a top right side of the connector device or pole joint of FIG. 31A.

Referring to FIGS. 30A-B, the female component 230 includes an outer section 232 having a second cavity for receiving an end of the other one of the poles 204 and an opposing inner section 234 having a housing for receiving the inner projection 214 of the male component 210. The pole 204 could be coupled to the cavity via fastener, adhesive or a combination of both. The housing includes a lower portion 236 and two opposing side portions 238. Each of the side portions 238 includes an axially extending second pivoting hole 240 substantially aligned with each other. Each of the side portions 238 also includes opposing guide grooves 243 having opposing ends 242 disposed on an upper end of each side portion 238. In the present embodiment, each end 242 of each guide groove 243 is sized substantially similar to or slightly smaller than ends of the cylindrical guide pin 218 of the male component 210. A distal end of the lower portion of the housing includes a second locking member 244 extending therefrom. In the preferred embodiment, the second locking member 244 is a channel formed between opposing upwardly extending channel walls 246. The channel 244 width is slightly narrower than the width of the first locking member 220 or extension 222 of the male component 210 such that the extension 222 is snap-fit into the channel 244 when engaged. In the present embodiment, the housing lower portion 236 extends longitudinally from an inner portion of the housing independent of the side portions 238 such that the housing lower portion 236 is elastically movable but the lower and side portions 236, 238 could be connected and integrally formed with each other without departing from the spirit and scope of the present invention. Similar to the male component 210, the female component 230 is also integrally formed of a hard molded plastic that is strong and durable, thus able to withstand the stresses exerted by the tent and tent poles. The female component could also include axial openings to reduce material cost for manufacturing, especially for larger connector devices used for larger tents to accommodate for larger poles.

Referring to FIGS. 28A-30B, the male and female components 210, 230 are pivotally coupled through the first and second pivoting holes 216, 240, preferably with a fastener or the like. The first and second locking members 220, 244 are lockably engaged when the poles are aligned as shown in FIG. 28A. That is, the first locking member 220 is lockably engaged frictionally within the channel 244 and the female component lower portion 236 prevents the male component 210 from rotating downward. The guide pin 218 and guide groove ends 242 are also engaged when the poles 202, 204 are aligned (FIG. 28A) and when the poles 202, 204 are pivoted 180 degrees substantially parallel and adjacent to each other (FIG. 28C), thus providing an additional locking function. The guide pin 218 is also guided along a curved or cammed outer edge of the guide groove 243 when the male and female components 210, 230 are rotated against each other. Thus, the connector device 200 allows the poles 202, 204 to pivot along a common plane and further stabilizes the poles 202, 204 in both aligned and folded configurations to eliminate or reduce the possibility of misalignment while providing a secure lock when the poles 202, 204 are aligned. Furthermore, the engagement of the guide pin 218 with the guide groove ends 242 located proximate the outer section 212 when the poles 202, 204 are in a folded configuration further prevents the poles 202, 204 from rotating further toward each other, thus, reducing the risk of damage to the connector device 200 in the event a user attempts to forcibly rotate the poles 202, 204 in such a manner. This additional securing mechanism, i.e., the guide pin 218 and guide groove ends 242, provides the additional stability to the connector device 200 for maintaining alignment of the male and female components 210, 230 when the poles are in the folded configuration. This additional feature is lacking in connector devices in the prior art that simply rely on a pin or fastener along a pivoting axis in an attempt to maintain alignment when the pole sections are folded.

Referring to FIGS. 31A-34B, another embodiment of a connector device or pole joint 300 is shown. In general, the connector device 300 includes a male component 310 pivotally coupled to a female component 330, which retains a pair of tent poles 302, 304, respectively, such that the poles 302, 304 are pivotally coupled when the poles 302, 304 are aligned in an aligned configuration as shown in FIG. 32A; when the poles 302, 304 are partially folded as shown in FIG. 33A; and when the poles 302, 304 are folded 180 degrees to substantially parallel and adjacent to each other in a folded configuration as shown in FIG. 34A.

Referring again to FIGS. 31A-34B, the male component 310 includes an outer section 312 having a first cavity for receiving an end of one of the poles 302 and an opposing inner section 314 having an inner projection. The pole 302 could be coupled to the cavity via fastener, adhesive or a combination of both. The inner projection includes opposing first and second sides 318, 320 and further includes a first pivoting hole 316 extending axially thereto. The inner projection first side 318 includes a pair of inner locking apertures 322 partially extending axially through the inner projection and which are substantially aligned diametrically. The inner projection second side 320 includes a substantially circular groove 324 partially extending axially through the inner projection. The inner projection second side 320 further includes a plurality of openings 326 partially extending axially through the inner projection. The male component 310 is integrally formed with a hard molded plastic and the openings 326 are included to reduce manufacturing costs on material, especially for larger connector devices used for larger tents to accommodate for larger poles, without compromising the strength and durability of the male component 310.

Referring again to FIGS. 31A-34B, the female component 330 includes an outer section 332 having a second cavity for receiving an end of the other one of the poles 304 and an opposing inner section 334 having a housing for receiving the inner projection of the male component 314. The pole 304 could be coupled to the cavity via fastener, adhesive or a combination of both. The housing includes a bottom wall 336 and two opposing first and second side walls 338, 340. The female component bottom wall 336 prevents the male component 310 from rotating downward. Each of the side walls 338, 340 includes an axially extending second pivoting hole 342 substantially aligned with each other. The first side wall 338 includes a pair of axially extending outer locking apertures 344. The pair of outer locking apertures 344 are substantially aligned diametrically and axially aligned with the inner locking apertures 322 of the male component 310. The female component 330 is integrally formed with a hard molded plastic and could include openings to reduce manufacturing costs on material, especially for larger connector devices used for larger tents to accommodate for larger poles, without compromising the strength and durability.

Still referring to FIGS. 31A-34B, the connector device 300 further includes a locking component 350 having a third pivoting hole 352 disposed proximate a center portion. The locking component 350 further includes a pair of spaced apart locking extensions 354 extending from an inner wall of the locking component 350, which are aligned with the inner and outer locking apertures 322, 344. An outer wall of the locking component 350 includes a depression 356 proximate the center portion for receiving a nut 358. The depression 356 is sized and shaped substantially similar to the nut 358 such that the nut 358 is form fit within the depression 356 and prevented from rotating. A biasing member 360, preferably a spring, is disposed within the male component circular groove 324 and is substantially aligned with the first and second pivoting holes 316, 342. A washer 364 is disposed between a distal end of the biasing member 360 and a distal end of a fastener 362. The locking component 350 and the washer 364 are constructed of a hard molded plastic for increased strength and durability but other materials such as metal could be used as well.

Figure 32A:
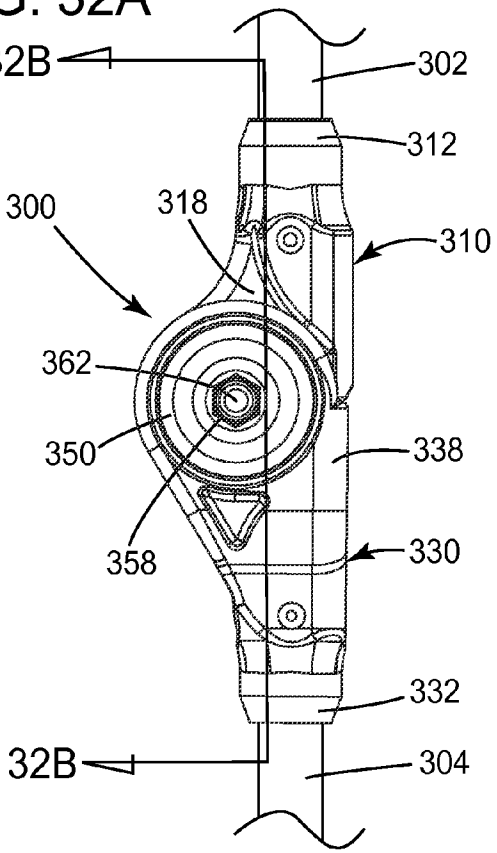
FIG. 32A is a side view of the connector device or pole joint of FIG. 31A in an aligned configuration.
Figure 32B:
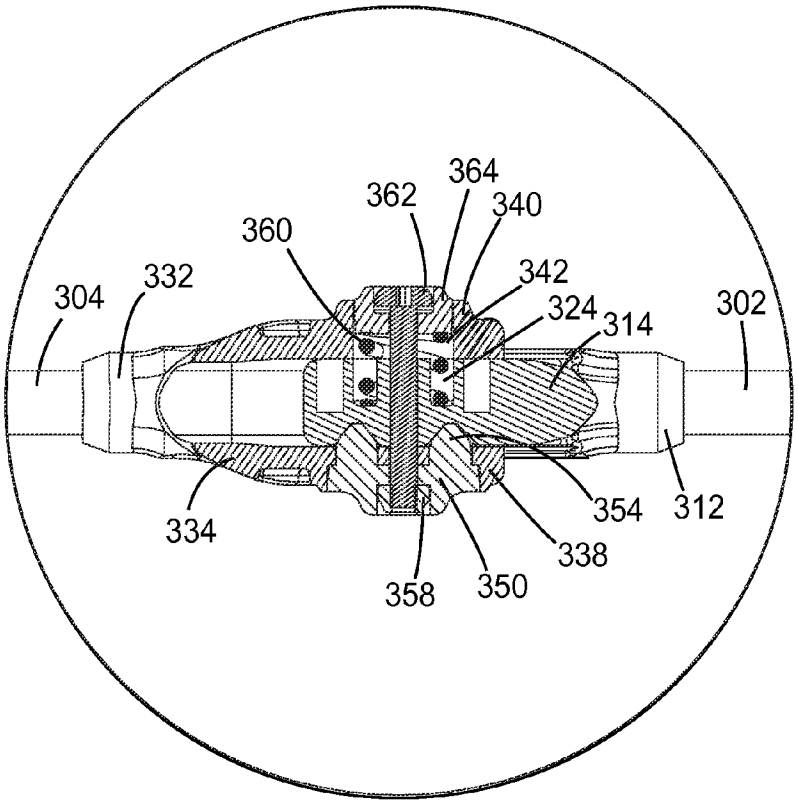
FIG. 32B is a sectional view of the connector device or pole joint of FIG. 32A.
Figure 33A:
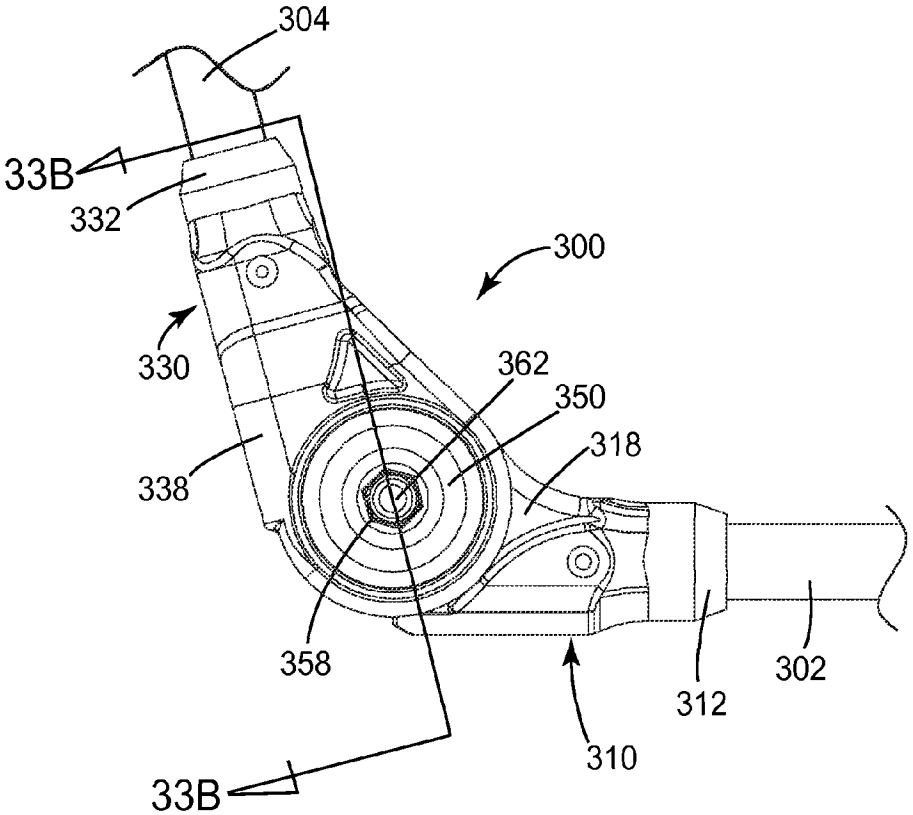
FIG. 33A is a side view of the connector device or pole joint of FIG. 31A in a partially folded configuration.
Figure 33B:
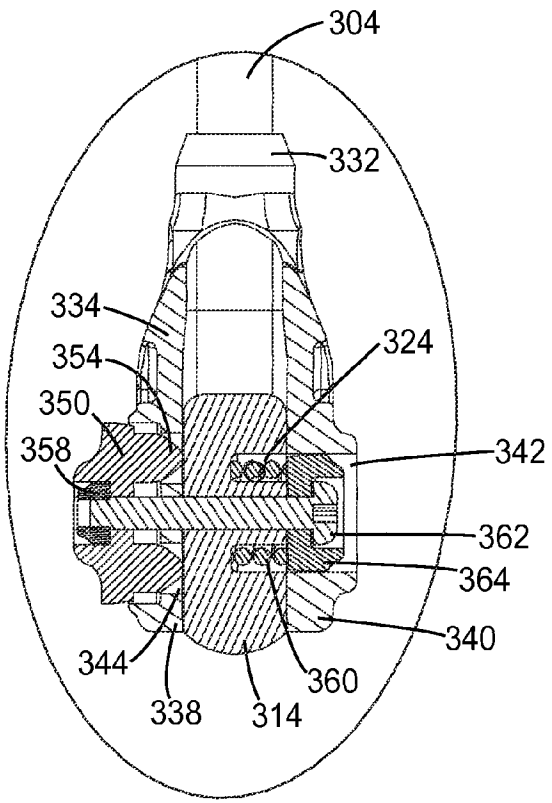
FIG. 33B is a sectional view of the connector device or pole joint of FIG. 33A.
Figure 34A:
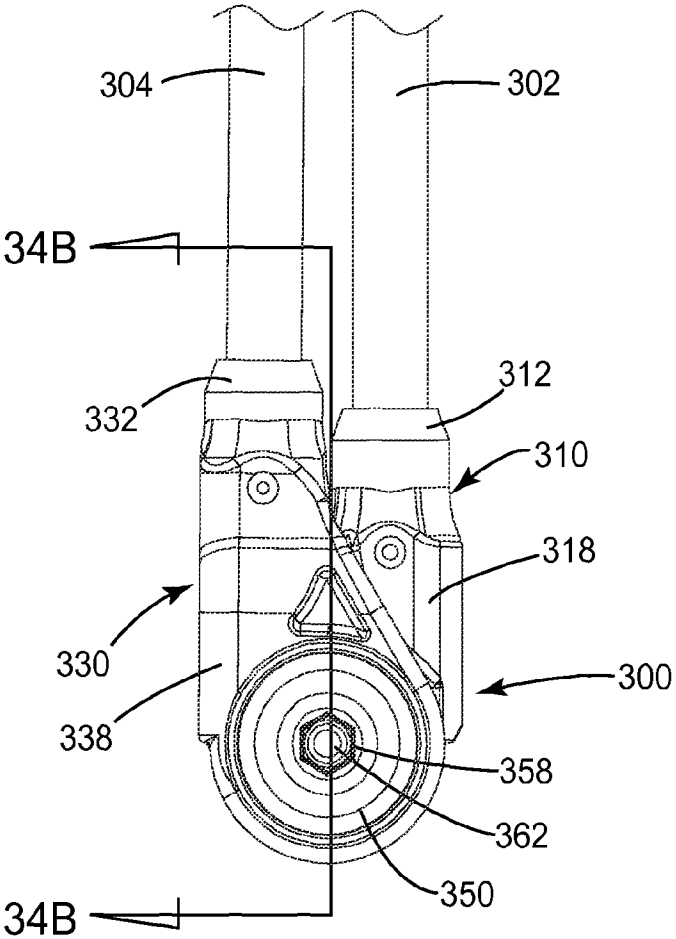
FIG. 34A is a side view of the connector device or pole joint of FIG. 31A in a folded configuration.
Figure 34B:
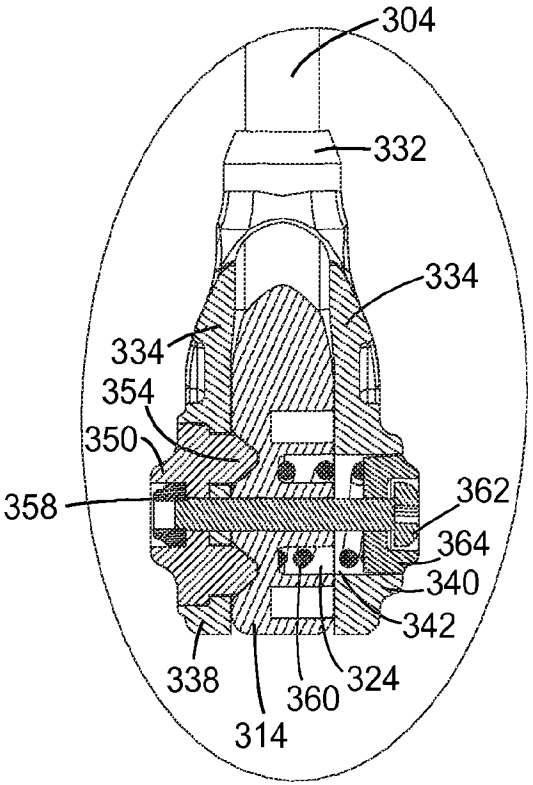
FIG. 34B is a sectional view of the connector device or pole joint of FIG. 34A.

Referring to FIGS. 32A-35B, the fastener 362 extends through the washer 364, biasing member 360, first and second pivoting holes 316, 342 of the male and female components 310, 330, respectively, and locking component 350, and is fixedly coupled to the nut 358 at a proximal end of the fastener 362. The fastener 362, washer 364, locking component 350 and nut 358 are fixed such that the overall length of the combined structure remains constant. Thus, the combined structure is movable axially such that the washer 364 is movable within the second pivoting hole 342 of the second side wall 340 and the locking component 350 is movable within the inner and outer locking apertures 322, 344. As shown in FIGS. 32A-B, when the poles 302, 304 are aligned in an aligned configuration the biasing member 360 is in an extended state and the washer 364 is positioned at an axially outer portion of the second side wall 340. The locking extensions 354 engage the inner and outer locking apertures 322, 344 such that the male component inner section 314 and female component inner section 334 are lockably engaged. Ends of the locking extensions 354 are formed at an angle and are concave to provide a smooth transition in and out of the inner locking apertures 322. As shown in FIGS. 33A-B, when the poles 302, 304 are pivoted toward each other, the male and female components 310, 330 rotate against each other causing the inner locking apertures 322 to rotate and disengage from the locking extensions 354. The locking extensions 354 engage a planar surface of the inner projection first side 318 (see FIG. 31B), while the locking extensions 354 rotate with the outer locking apertures 344. In this configuration, the combined structure comprising the fastener 362, washer 364, locking component 350 and nut 358 is displaced toward the first side wall 338 as the biasing member 360 is compressed. As shown in FIGS. 34A-B, when the poles 302, 304 are pivoted 180 degrees substantially parallel and adjacent to each other in a folded configuration the inner locking apertures 322 are aligned again with the outer locking apertures 344 so that the locking extensions 354 extend through the inner and outer locking apertures 322, 344 to form a lockable engagement between the male and female components 310, 330. In this configuration, the combined structure comprising the fastener 362, washer 364, locking component 350 and nut 358 is displaced toward the second side wall 340 as the biasing member 360 is extended. Furthermore, the engagement of the locking extensions 354 with the inner and outer locking apertures 322, 344 when the poles 302, 304 are in a folded configuration further prevents the poles 302, 304 from rotating further toward each other, thus, reducing the risk of damage to the connector device 300 in the event a user attempts to forcibly rotate the poles 302, 304 in such a manner. This additional securing mechanism, i.e., the locking extensions 354 engaged with the inner and outer locking apertures 322, 344, provides the additional stability to the connector device 300 for maintaining alignment of the male and female components 310, 330 when the poles are in the folded configuration. This additional feature is lacking in connector devices in the prior art that simply rely on a pin or fastener along a pivoting axis in an attempt to maintain alignment when the pole sections are folded.

One of ordinary skill in the art will recognize that the alternative embodiments of the connector devices 200, 300 could be used to couple any two pole sections of any type of tent frame. For example, the connector device 200, 300 could replace either first pivotal coupling member 41, 141 described above and could also replace the above-described second pivotal coupling member 51. The connector devices 200, 300 could also be used on more conventional foldable tents having a central hub, i.e. instant tents.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A connector device for retaining a pair of pivotally connected poles, the connector device comprising:

a male component comprising an outer section having a first cavity for receiving an end of one of the poles and an opposing inner section having an inner projection, the inner projection comprising: an axially extending first pivoting hole, an axially extending guide pin and a first locking member extending along a bottom portion of the inner projection; and a female component comprising an outer section having a second cavity for receiving an end of the other one of the poles and an opposing inner section having a housing for receiving the inner projection of the male component, the housing comprising a lower portion and two opposing side portions, each of the side portions having an axially extending second pivoting hole substantially aligned with each other, each of the side portions having opposing guide grooves, each guide groove having opposing ends, a distal end of the lower portion of the housing having a second locking member extending therefrom;

wherein the male and female components are pivotally coupled through the first and second pivoting holes, the first and second locking members are lockably engaged when the poles are aligned, and the guide pin and guide groove ends are engaged when the poles are aligned longitudinally and when the poles are pivoted 180 degrees substantially parallel and adjacent to each other;

wherein the first and second pivoting holes have substantially the same size and shape; and wherein the bottom portion of the inner projection includes a void directly above the first locking member for receiving the second locking member.

2. The connector device of claim 1, wherein the first locking member is a bar extending longitudinally along the bottom portion of the inner projection and integrally thereto.

3. The connector device of claim 2, wherein the second locking member comprises a channel for engaging the bar.

4. A connector device for retaining a pair of pivotally connected poles, the connector device comprising:

a male component comprising an outer section having a first cavity for receiving an end of one of the poles and an opposing inner section having an inner projection, the inner projection comprising: an axially extending first pivoting hole, an axially extending guide pin and a first locking member extending along a bottom portion of the inner projection; and a female component comprising an outer section having a second cavity for receiving an end of the other one of the poles and an opposing inner section having a housing for receiving the inner projection of the male component, the housing comprising a lower portion and two opposing side portions, each of the side portions having an axially extending second pivoting hole substantially aligned with each other, each of the side portions having opposing guide grooves, each guide groove having opposing ends, a distal end of the lower portion of the housing having a second locking member extending therefrom;

wherein the male and female components are pivotally coupled through the first and second pivoting holes, the first and second locking members are lockably engaged when the poles are aligned, and the guide pin and guide groove ends are engaged when the poles are aligned longitudinally and when the poles are pivoted 180 degrees substantially parallel and adjacent to each other;

wherein the first and second pivoting holes have substantially the same size and shape; and wherein the guide pin is substantially cylindrical and each guide groove end is sized substantially similar to the ends of the cylindrical guide pin.

5. The connector device of claim 4, wherein each guide groove is disposed on an upper end of each housing side portion.

6. A connector device for retaining a pair of pivotally connected poles, the connector device comprising:

a male component comprising an outer section having a first cavity for receiving an end of one of the poles and an opposing inner section having an inner projection, the inner projection having opposing first and a second side walls, the inner projection having a first pivoting hole extending axially at a central portion;

a first guiding member extending axially from the inner projection;

a first locking member formed on the inner projection;

a female component comprising an outer section having a second cavity for receiving an end of the other one of the poles and an opposing inner section having a housing for receiving the inner projection of the male component, the housing having a bottom wall and opposing first and second side walls, the first and second side walls having an axially extending second pivoting hole;

a second guiding member extending axially from the housing; and a second locking member formed on the housing;

wherein the male and female components are pivotally coupled together through the first and second pivoting holes, the first and second locking members are engaged so as to secure the poles in a substantially aligned configuration, and the first and second guiding members are engaged when the poles are in the aligned configuration and when the poles are pivoted 180 degrees substantially parallel and adjacent to each other in a folded configuration;

wherein the first and second pivoting holes have substantially the same size and shape; and wherein the first guiding member comprises a substantially cylindrical pin integrally formed on opposing side walls of the inner projection and the second guiding member comprises a groove disposed on an upper end of each housing side wall, each groove having opposing ends and sized substantially similar to ends of the pin.

7. A connector device for retaining a pair of pivotally connected poles, the connector device comprising:

a male component comprising an outer section having a first cavity for receiving an end of one of the poles and an opposing inner section having an inner projection, the inner projection having opposing first and a second side walls, the inner projection having a first pivoting hole extending axially at a central portion;

a first guiding member extending axially from the inner projection;

a first locking member formed on the inner projection;

a female component comprising an outer section having a second cavity for receiving an end of the other one of the poles and an opposing inner section having a housing for receiving the inner projection of the male component, the housing having a bottom wall and opposing first and second side walls, the first and second side walls having an axially extending second pivoting hole;

a second guiding member extending axially from the housing; and a second locking member formed on the housing;

wherein the male and female components are pivotally coupled together through the first and second pivoting holes, the first and second locking members are engaged so as to secure the poles in a substantially aligned configuration, and the first and second guiding members are engaged when the poles are in the aligned configuration and when the poles are pivoted 180 degrees substantially parallel and adjacent to each other in a folded configuration;

wherein the first and second pivoting holes have substantially the same size and shape; and wherein the first locking member comprises a bar extending longitudinally along a bottom portion of the inner projection and integrally thereto, and the second locking member comprises a longitudinal channel sized substantially similar to the bar formed on a distal end of the bottom wall of the housing.

8. The connector device of claim 7, wherein the bottom portion of the inner projection includes a void directly above the first locking member for receiving the second locking member.

9. A connector device for retaining a pair of pivotally connected poles, the connector device comprising:

a male component comprising an outer section having a first cavity for receiving an end of one of the poles and an opposing inner section having an inner projection the inner projection comprising: an axially extending first pivoting hole, an axially extending guide pin and a first locking member extending along a bottom portion of the inner projection; and a female component comprising an outer section having a second cavity for receiving an end of the other one of the poles and an opposing inner section having a housing for receiving the inner projection of the male component, the housing comprising a lower portion and two opposing side portions, each of the side portions having an axially extending second pivoting hole substantially aligned with each other, each of the side portions having opposing guide grooves, each guide groove having opposing ends, a distal end of the lower portion of the housing having a second locking member extending therefrom;

wherein the male and female components are pivotally coupled through the first and second pivoting holes, the first and second locking members are lockably engaged when the poles are aligned, and the guide pin and guide groove ends are engaged when the poles are aligned longitudinally and when the poles are pivoted 180 degrees substantially parallel and adjacent to each other;

wherein the first and second pivoting holes have substantially the same size and shape;

wherein the first locking member comprises an extension extending from the inner projection; and wherein the second locking member comprises a channel.

10. The connector device of claim 9, wherein the extension is engaged with the channel when the poles are aligned.

11. A connector device for retaining a pair of pivotally connected poles, the connector device comprising:

a male component comprising an outer section having a first cavity for receiving an end of one of the poles and an opposing inner section having an inner projection, the inner projection having opposing first and a second side walls, the inner projection having a first pivoting hole extending axially at a central portion;

a first guiding member extending axially from the inner projection;

a first locking member formed on the inner projection;

a female component comprising an outer section having a second cavity for receiving an end of the other one of the poles and an opposing inner section having a housing for receiving the inner projection of the male component, the housing having a bottom wall and opposing first and second side walls, the first and second side walls having an axially extending second pivoting hole;

a second guiding member extending axially from the housing; and a second locking member formed on the housing;

wherein the male and female components are pivotally coupled together through the first and second pivoting holes, the first and second locking members are engaged so as to secure the poles in a substantially aligned configuration, and the first and second guiding members are engaged when the poles are in the aligned configuration and when the poles are pivoted 180 degrees substantially parallel and adjacent to each other in a folded configuration;

wherein the first and second pivoting holes have substantially the same size and shape; and wherein: the first locking member comprises an extension extending from the inner projection; the second locking member comprises a channel; and the extension is engaged with the channel when the poles are in the aligned configuration.

* * * * *